US007686681B2

(12) United States Patent
Soltys et al.

(10) Patent No.: US 7,686,681 B2
(45) Date of Patent: Mar. 30, 2010

(54) SYSTEMS, METHODS AND ARTICLES TO FACILITATE PLAYING CARD GAMES WITH SELECTABLE ODDS

(75) Inventors: Richard Soltys, Newcastle, WA (US); Richard Huizinga, Newcastle, WA (US)

(73) Assignee: IGT, Reno, NV (US)

( * ) Notice: Subject to any disclaimer, the term of this patent is extended or adjusted under 35 U.S.C. 154(b) by 113 days.

(21) Appl. No.: 11/437,590

(22) Filed: May 19, 2006

(65) Prior Publication Data

US 2006/0211481 A1 Sep. 21, 2006

Related U.S. Application Data

(63) Continuation of application No. 10/017,276, filed on Dec. 13, 2001, now Pat. No. 7,390,256.

(60) Provisional application No. 60/296,866, filed on Jun. 8, 2001.

(51) Int. Cl.
*G06F 19/00* (2006.01)

(52) U.S. Cl. ..... 463/11; 463/22; 273/293; 273/304

(58) Field of Classification Search ..... 463/10–13, 463/16–22, 25, 29, 40–42; 273/138.1, 139, 273/142 B, 142 A, 142 J, 148 A, 148 R, 148 B, 273/149 P, 149 R, 274, 292–293, 304, 306, 273/309; 283/49, 903; *G06F 19/00; A63F 1/18*
See application file for complete search history.

(56) References Cited

U.S. PATENT DOCUMENTS

| | | | | |
|---|---|---|---|---|
| 1,034,402 | A | 7/1912 | Hardy | |
| 1,727,800 | A | 9/1929 | Albert | |
| 1,890,504 | A | 12/1932 | Ferguson, Jr. | |
| 2,567,223 | A | 9/1951 | Maher et al. | |
| 2,663,418 | A | 12/1953 | Grunwald | 206/62 |
| 2,694,662 | A | 11/1954 | Hunter, Jr. | 154/121 |
| 2,731,271 | A | 1/1956 | Brown | |
| 3,222,071 | A | 12/1965 | Lang | 273/149 |
| 3,312,473 | A | 4/1967 | Friedman et al. | 273/149 |
| 3,377,070 | A | 4/1968 | Nottoli | 273/149 |
| 3,493,728 | A | 2/1970 | Braden, Jr. et al. | |
| 3,561,756 | A | 2/1971 | Barnett | 271/41 |
| 3,667,759 | A | 6/1972 | Barr | 273/152.1 |

(Continued)

FOREIGN PATENT DOCUMENTS

DE 44 39 502 C1 9/1995

(Continued)

OTHER PUBLICATIONS

U.S. Appl. No. 10/885,875, filed Jul. 7, 2004, Soltys et al.

(Continued)

*Primary Examiner*—Peter DungBa Vo
*Assistant Examiner*—Arthur O. Hall
(74) *Attorney, Agent, or Firm*—Armstrong Teasdale LLP

(57) ABSTRACT

A system and method forms playing card markings on playing card media to provide playing cards based on a desired set of payout or house odds and/or house advantage. The playing cards may, for example, be printed in a random or pseudo-random order that is based on the selected payout or house odds and/or house advantage.

16 Claims, 10 Drawing Sheets

U.S. PATENT DOCUMENTS

| | | | | | |
|---|---|---|---|---|---|
| 3,690,670 | A | | 9/1972 | Cassady et al. | 273/149 P |
| 3,735,982 | A | * | 5/1973 | Gerfin | 463/22 |
| 3,751,041 | A | | 8/1973 | Seifert | 273/149 |
| 3,752,962 | A | | 8/1973 | Greskovics | 235/61.11 D |
| 3,766,452 | A | | 10/1973 | Burpee et al. | 317/262 R |
| 3,810,172 | A | | 5/1974 | Burpee et al. | 343/5 PD |
| 3,814,436 | A | | 6/1974 | Boren | 273/149 P |
| 3,897,954 | A | | 8/1975 | Erickson et al. | 273/149 R |
| 3,929,339 | A | | 12/1975 | Mattioli | 273/148 A |
| 4,026,309 | A | | 5/1977 | Howard | 133/8 R |
| 4,031,376 | A | | 6/1977 | Corkin, Jr. | 235/156 |
| 4,241,921 | A | | 12/1980 | Miller | 273/148 A |
| 4,244,582 | A | | 1/1981 | Raees et al. | 273/293 |
| 4,310,160 | A | | 1/1982 | Willette et al. | 273/149 R |
| 4,373,726 | A | | 2/1983 | Churchill et al. | 273/138 A |
| 4,377,285 | A | | 3/1983 | Kadlic | 273/148 A |
| 4,448,419 | A | | 5/1984 | Telnaes | 273/143 R |
| 4,457,512 | A | | 7/1984 | Stevenson | 273/148 A |
| 4,497,488 | A | | 2/1985 | Plevyak et al. | 273/149 R |
| 4,531,187 | A | | 7/1985 | Uhland | 364/412 |
| 4,531,909 | A | | 7/1985 | Takeshita | 432/37 |
| 4,534,562 | A | | 8/1985 | Cuff et al. | 273/149 P |
| 4,586,712 | A | | 5/1986 | Lorber et al. | 273/149 R |
| 4,636,846 | A | | 1/1987 | Villarreal | 358/100 |
| 4,656,463 | A | | 4/1987 | Anders et al. | 340/572 |
| 4,659,082 | A | | 4/1987 | Greenberg | 273/149 R |
| 4,662,637 | A | | 5/1987 | Pfeiffer | 273/149 P |
| 4,667,959 | A | | 5/1987 | Pfeiffer et al. | 273/149 R |
| 4,693,480 | A | | 9/1987 | Smith | 273/296 |
| 4,725,079 | A | | 2/1988 | Koza et al. | 283/73 |
| 4,728,108 | A | | 3/1988 | Neuwahl | 273/296 |
| 4,750,743 | A | | 6/1988 | Nicoletti | 273/148 A |
| 4,755,941 | A | | 7/1988 | Bacchi | 364/412 |
| 4,770,421 | A | | 9/1988 | Hoffman | 273/149 R |
| 4,807,884 | A | | 2/1989 | Breeding | 273/149 R |
| 4,814,589 | A | | 3/1989 | Storch et al. | 235/375 |
| 4,817,528 | A | | 4/1989 | Baker | 101/395 |
| 4,822,050 | A | | 4/1989 | Normand et al. | 273/149 P |
| 4,832,341 | A | | 5/1989 | Muller et al. | 273/139 |
| 4,832,342 | A | | 5/1989 | Plevyak et al. | 273/149 R |
| 4,861,041 | A | | 8/1989 | Jones et al. | 273/292 |
| 4,885,700 | A | | 12/1989 | Kondziolka et al. | 364/519 |
| 4,926,996 | A | | 5/1990 | Eglise et al. | 194/212 |
| 4,951,950 | A | | 8/1990 | Normand et al. | 273/149 P |
| 4,969,648 | A | | 11/1990 | Hollinger et al. | 273/149 R |
| 4,995,615 | A | | 2/1991 | Cheng | 273/292 |
| 4,998,737 | A | | 3/1991 | Lamle | 273/296 |
| 5,000,453 | A | | 3/1991 | Stevens et al. | 273/149 R |
| 5,007,641 | A | | 4/1991 | Seidman | 273/138 A |
| 5,039,102 | A | | 8/1991 | Miller | 273/148 R |
| 5,042,809 | A | * | 8/1991 | Richardson | 463/18 |
| 5,053,612 | A | | 10/1991 | Pielemeier et al. | 235/462 |
| 5,067,713 | A | | 11/1991 | Soules et al. | 273/149 P |
| 5,096,197 | A | | 3/1992 | Embury | 273/149 R |
| 5,103,081 | A | | 4/1992 | Fisher et al. | 235/464 |
| 5,110,134 | A | | 5/1992 | Laughlin et al. | 273/293 |
| 5,114,153 | A | | 5/1992 | Rosenwinkel et al. | 273/292 |
| 5,121,921 | A | | 6/1992 | Friedman et al. | 273/149 P |
| 5,156,397 | A | * | 10/1992 | Valenza, Jr. | 463/25 |
| 5,157,602 | A | * | 10/1992 | Fields et al. | 463/22 |
| 5,166,502 | A | | 11/1992 | Rendleman et al. | 235/492 |
| 5,179,517 | A | | 1/1993 | Sarbin et al. | 364/410 |
| 5,186,464 | A | | 2/1993 | Lamle | 273/149 R |
| 5,199,710 | A | * | 4/1993 | Lamle | 463/22 |
| 5,216,234 | A | | 6/1993 | Bell | 235/494 |
| 5,224,712 | A | | 7/1993 | Laughlin et al. | 273/304 |
| 5,240,140 | A | | 8/1993 | Huen | 221/13 |
| 5,258,837 | A | | 11/1993 | Gormley | 358/140 |
| 5,259,907 | A | | 11/1993 | Soules et al. | 156/277 |
| 5,261,667 | A | | 11/1993 | Breeding | 273/149 R |
| 5,273,281 | A | * | 12/1993 | Lovell | 273/138.1 |
| 5,275,411 | A | | 1/1994 | Breeding | 273/149 R |
| 5,283,422 | A | | 2/1994 | Storch et al. | 235/375 |
| 5,303,921 | A | | 4/1994 | Breeding | 273/149 R |
| 5,312,104 | A | | 5/1994 | Miller | 273/148 R |
| 5,332,219 | A | * | 7/1994 | Marnell et al. | 463/13 |
| 5,344,146 | A | | 9/1994 | Lee | 273/149 R |
| 5,356,145 | A | | 10/1994 | Verschoor | 273/149 R |
| 5,362,053 | A | | 11/1994 | Miller | 273/148 R |
| 5,364,104 | A | | 11/1994 | Jones et al. | 273/292 |
| 5,374,061 | A | | 12/1994 | Albrecht | 273/149 R |
| 5,382,024 | A | | 1/1995 | Blaha | 273/149 R |
| 5,397,133 | A | | 3/1995 | Penzias | 273/439 |
| 5,406,264 | A | | 4/1995 | Plonsky et al. | 340/572 |
| 5,416,308 | A | | 5/1995 | Hood et al. | 235/454 |
| 5,417,431 | A | | 5/1995 | Gluck | 273/293 |
| 5,431,399 | A | | 7/1995 | Kelley | 273/149 P |
| 5,445,377 | A | | 8/1995 | Steinbach | 273/149 R |
| 5,458,333 | A | | 10/1995 | Takemoto et al. | 273/138 A |
| 5,487,544 | A | | 1/1996 | Clapper, Jr. | 273/138 A |
| 5,511,784 | A | | 4/1996 | Furry et al. | 273/143 R |
| 5,518,249 | A | | 5/1996 | Sines et al. | 273/304 |
| 5,575,475 | A | | 11/1996 | Steinbach | 273/149 R |
| 5,584,483 | A | | 12/1996 | Sines et al. | 273/149 R |
| 5,586,936 | A | | 12/1996 | Bennett et al. | 463/25 |
| 5,605,334 | A | | 2/1997 | McCrea, Jr. | 273/309 |
| 5,605,504 | A | | 2/1997 | Huang | 463/22 |
| 5,613,680 | A | | 3/1997 | Groves et al. | 273/138.2 |
| 5,613,912 | A | | 3/1997 | Slater | 463/25 |
| 5,632,483 | A | * | 5/1997 | Garczynski et al. | 273/148 R |
| 5,636,843 | A | * | 6/1997 | Roberts | 273/292 |
| 5,645,486 | A | | 7/1997 | Nagao et al. | 463/27 |
| 5,647,592 | A | * | 7/1997 | Gerow | 273/139 |
| 5,651,548 | A | | 7/1997 | French et al. | 273/309 |
| 5,654,050 | A | | 8/1997 | Whalen-Shaw | 428/35.7 |
| 5,655,961 | A | | 8/1997 | Acres et al. | 463/27 |
| 5,669,816 | A | | 9/1997 | Garczynski et al. | 463/12 |
| 5,676,372 | A | | 10/1997 | Sines et al. | 273/149 R |
| 5,676,376 | A | | 10/1997 | Valley | 273/288 |
| 5,681,039 | A | | 10/1997 | Miller | 273/148 R |
| 5,683,085 | A | | 11/1997 | Johnson et al. | 273/149 R |
| 5,685,543 | A | | 11/1997 | Garner | 273/148 A |
| 5,690,324 | A | * | 11/1997 | Otomo et al. | 270/58.02 |
| 5,692,748 | A | | 12/1997 | Frisco et al. | 273/149 R |
| 5,695,189 | A | | 12/1997 | Breeding et al. | 273/149 R |
| 5,698,839 | A | | 12/1997 | Jagielinski et al. | 235/493 |
| 5,707,287 | A | | 1/1998 | McCrea, Jr. | 463/27 |
| 5,711,525 | A | | 1/1998 | Breeding | 273/292 |
| 5,718,427 | A | | 2/1998 | Cranford et al. | 273/149 R |
| 5,722,893 | A | | 3/1998 | Hill et al. | 463/47 |
| 5,735,525 | A | | 4/1998 | McCrea, Jr. | 273/309 |
| 5,735,742 | A | | 4/1998 | French | 463/25 |
| 5,742,656 | A | | 4/1998 | Mikulak et al. | 377/7 |
| 5,755,618 | A | | 5/1998 | Mothwurf | 453/17 |
| 5,757,876 | A | | 5/1998 | Dam et al. | 377/7 |
| 5,766,074 | A | | 6/1998 | Cannon et al. | 463/16 |
| 5,769,458 | A | | 6/1998 | Carides et al. | 283/102 |
| 5,770,533 | A | | 6/1998 | Franchi | 463/42 |
| 5,772,505 | A | | 6/1998 | Garczynski et al. | 463/12 |
| 5,779,545 | A | | 7/1998 | Berg et al. | 463/22 |
| 5,779,546 | A | | 7/1998 | Meissner et al. | 463/25 |
| 5,781,647 | A | | 7/1998 | Fishbine et al. | 382/1 |
| 5,785,321 | A | | 7/1998 | van Putten et al. | 273/309 |
| 5,788,573 | A | | 8/1998 | Baerlocher et al. | 463/16 |
| 5,788,574 | A | | 8/1998 | Ornstein et al. | 463/25 |
| 5,791,988 | A | | 8/1998 | Nomi | 463/11 |
| 5,801,766 | A | | 9/1998 | Alden | 348/157 |
| 5,803,808 | A | | 9/1998 | Strisower | 463/11 |
| 5,803,809 | A | * | 9/1998 | Yoseloff | 463/13 |
| 5,809,482 | A | | 9/1998 | Strisower | 705/30 |
| 5,816,918 | A | * | 10/1998 | Kelly et al. | 463/16 |
| 5,830,064 | A | | 11/1998 | Bradish et al. | 463/22 |
| 5,831,669 | A | | 11/1998 | Adrain | 348/143 |
| 5,833,536 | A | * | 11/1998 | Davids et al. | 463/11 |

5,842,921 A 12/1998 Mindes et al. ..... 463/16
5,863,249 A 1/1999 Inoue ..... 463/20
5,871,400 A 2/1999 Yfantis ..... 463/22
5,895,048 A 4/1999 Smith, Jr. ..... 273/293
5,895,321 A 4/1999 Gassies et al. ..... 463/29
5,909,876 A 6/1999 Brown ..... 273/309
5,911,626 A 6/1999 McCrea, Jr. ..... 463/27
5,919,090 A 7/1999 Mothwurf ..... 463/25
5,919,091 A 7/1999 Bell et al. ..... 463/25
5,931,731 A 8/1999 Chwalisz ..... 453/32
5,941,769 A 8/1999 Order ..... 463/12
5,941,771 A 8/1999 Haste, III ..... 463/17
5,944,310 A 8/1999 Johnson et al. ..... 273/149 R
5,945,654 A 8/1999 Huang ..... 235/449
5,947,821 A * 9/1999 Stone ..... 463/13
5,949,050 A 9/1999 Fosbenner et al. ..... 235/449
5,954,654 A 9/1999 Eaton et al. ..... 600/462
5,957,776 A 9/1999 Hoehne ..... 463/25
5,967,893 A 10/1999 Lawrence et al. ..... 463/10
5,967,894 A * 10/1999 Kinoshita et al. ..... 463/13
5,980,385 A * 11/1999 Clapper, Jr. ..... 463/17
5,989,122 A 11/1999 Roblejo ..... 463/22
6,010,404 A 1/2000 Walker et al. ..... 463/21
6,019,368 A 2/2000 Sines et al. ..... 273/149 R
6,021,949 A 2/2000 Boiron ..... 235/492
6,029,891 A 2/2000 Freeman et al. ..... 235/380
6,039,650 A * 3/2000 Hill ..... 463/47
6,042,150 A 3/2000 Daley ..... 283/86
6,062,981 A 5/2000 Luciano, Jr. ..... 463/26
6,068,258 A 5/2000 Breeding et al. ..... 273/149 R
6,068,552 A 5/2000 Walker et al. ..... 463/21
6,093,103 A 7/2000 McCrea, Jr. ..... 463/27
6,117,009 A * 9/2000 Yoseloff ..... 463/20
6,117,012 A 9/2000 McCrea, Jr. ..... 463/27
6,126,166 A 10/2000 Lorson et al. ..... 273/148 R
6,139,014 A 10/2000 Breeding et al. ..... 273/149 R
6,142,876 A 11/2000 Cumbers ..... 463/25
6,145,838 A 11/2000 White ..... 273/295
6,149,154 A 11/2000 Grauzer et al. ..... 273/149 R
6,152,822 A * 11/2000 Herbert ..... 463/22
6,154,131 A 11/2000 Jones, II et al. ..... 340/540
6,159,096 A * 12/2000 Yoseloff ..... 463/20
6,161,476 A * 12/2000 Yoneoka ..... 101/118
6,165,069 A 12/2000 Sines et al. ..... 463/12
6,166,763 A 12/2000 Rhodes et al. ..... 348/143
6,186,892 B1 2/2001 Frank et al. ..... 463/19
6,186,895 B1 2/2001 Oliver ..... 463/25
6,193,607 B1 2/2001 Kay ..... 463/22
6,196,547 B1 3/2001 Pascal et al. ..... 273/292
6,200,218 B1 3/2001 Lindsay ..... 463/25
6,217,447 B1 4/2001 Lofink et al. ..... 463/12
6,234,898 B1 5/2001 Belamant et al. ..... 463/25
6,250,632 B1 6/2001 Albrecht ..... 273/149 R
6,254,096 B1 7/2001 Grauzer et al. ..... 273/149 R
6,254,484 B1 7/2001 McCrea, Jr. ..... 463/27
6,264,109 B1 7/2001 Chapet et al. ..... 235/492
6,267,248 B1 7/2001 Johnson et al. ..... 209/547
6,267,671 B1 7/2001 Hogan ..... 463/25
6,276,267 B1 * 8/2001 Yoneoka ..... 101/114
6,283,856 B1 9/2001 Mothwurf ..... 463/17
6,293,546 B1 9/2001 Hessing et al. ..... 273/138.2
6,293,864 B1 9/2001 Romero ..... 463/12
6,299,167 B1 10/2001 Sines et al. ..... 273/149 R
6,299,170 B1 10/2001 Yoseloff ..... 273/292
6,299,534 B1 10/2001 Breeding et al. ..... 463/25
6,299,536 B1 10/2001 Hill ..... 463/47
6,312,334 B1 11/2001 Yoseloff ..... 463/25
6,313,871 B1 11/2001 Schubert ..... 348/143
6,315,664 B1 11/2001 Baerlocher et al. ..... 463/21
6,322,445 B1 * 11/2001 Miller ..... 463/13
6,325,373 B1 12/2001 Breeding et al. ..... 273/149 R
6,346,044 B1 2/2002 McCrea, Jr. ..... 463/27
6,352,261 B1 3/2002 Brown ..... 273/288
6,357,746 B1 3/2002 Sadowski ..... 273/148 R
6,361,044 B1 3/2002 Block et al. ..... 273/149 R
6,371,482 B1 4/2002 Hall, Jr. ..... 273/138.1
6,386,973 B1 5/2002 Yoseloff ..... 463/13
6,394,902 B1 5/2002 Glavich et al. ..... 463/20
6,402,142 B1 6/2002 Warren et al. ..... 273/149 R
6,403,908 B2 6/2002 Stardust et al. ..... 209/587
6,406,023 B1 6/2002 Rowe ..... 273/292
6,406,369 B1 6/2002 Baerlocher et al. ..... 463/20
6,409,595 B1 6/2002 Uihlein et al. ..... 463/29
6,413,162 B1 7/2002 Baerlocher et al. ..... 463/20
6,425,817 B1 7/2002 Momemy ..... 453/17
6,425,824 B1 7/2002 Baerlocher et al. ..... 463/16
6,446,864 B1 9/2002 Kim et al. ..... 235/382
6,457,715 B1 10/2002 Friedman ..... 273/274
6,460,848 B1 10/2002 Soltys et al. ..... 273/149 R
6,464,581 B1 10/2002 Yoseloff ..... 463/20
6,464,584 B2 10/2002 Oliver ..... 463/25
6,468,156 B1 10/2002 Hughs-Baird et al. ..... 463/25
6,471,208 B2 10/2002 Yoseloff et al. ..... 273/143 R
6,478,676 B1 * 11/2002 Dayan ..... 463/17
6,485,366 B1 11/2002 Rowe ..... 463/13
6,502,116 B1 12/2002 Kelly et al. ..... 708/250
6,503,147 B1 1/2003 Stockdale et al. ..... 463/29
6,508,709 B1 1/2003 Karmarkar ..... 463/42
6,514,140 B1 2/2003 Storch ..... 463/25
6,517,435 B2 2/2003 Soltys et al. ..... 463/25
6,517,436 B2 2/2003 Soltys et al. ..... 463/29
6,517,437 B1 2/2003 Wells et al. ..... 463/30
6,520,857 B2 2/2003 Soltys et al. ..... 463/29
6,527,271 B2 3/2003 Soltys et al. ..... 273/148 R
6,530,836 B2 3/2003 Soltys et al. ..... 463/29
6,530,837 B2 3/2003 Soltys et al. ..... 463/29
6,532,297 B1 3/2003 Lindquist ..... 382/100
6,533,276 B2 3/2003 Soltys et al. ..... 273/148 R
6,533,662 B2 3/2003 Soltys et al. ..... 463/25
6,533,664 B1 3/2003 Crumby ..... 463/42
6,543,770 B1 4/2003 Kaji et al. ..... 273/148 R
6,561,897 B1 5/2003 Bourbour et al. ..... 463/13
6,567,159 B1 5/2003 Corech ..... 356/71
6,568,678 B2 5/2003 Breeding et al. ..... 273/149 R
6,575,834 B1 6/2003 Lindo ..... 463/40
6,579,179 B2 6/2003 Poole et al. ..... 463/25
6,579,180 B2 6/2003 Soltys et al. ..... 463/25
6,579,181 B2 6/2003 Soltys et al. ..... 463/25
6,581,747 B1 6/2003 Charlier et al. ..... 194/214
6,582,301 B2 6/2003 Hill ..... 463/11
6,588,750 B1 7/2003 Grauzer et al. ..... 273/149 R
6,588,751 B1 * 7/2003 Grauzer et al. ..... 273/149 R
6,595,857 B2 7/2003 Soltys et al. ..... 463/29
6,599,185 B1 7/2003 Kaminkow et al. ..... 463/16
6,620,046 B2 9/2003 Rowe ..... 463/25
6,629,591 B1 10/2003 Griswold et al. ..... 194/205
6,629,889 B2 10/2003 Mothwurf ..... 463/25
6,638,161 B2 10/2003 Soltys et al. ..... 463/12
6,645,077 B2 11/2003 Rowe ..... 463/42
6,651,981 B2 11/2003 Grauzer et al. ..... 273/149 R
6,651,982 B2 11/2003 Grauzer et al. ..... 273/149 R
6,651,985 B2 * 11/2003 Sines et al. ..... 273/309
6,652,379 B2 11/2003 Soltys et al. ..... 463/22
6,655,684 B2 12/2003 Grauzer et al. ..... 273/149 R
6,659,460 B2 12/2003 Blaha et al. ..... 273/149 R
6,663,490 B2 12/2003 Soltys et al. ..... 463/25
6,676,127 B2 1/2004 Johnson et al. ..... 273/149 R
6,676,516 B2 1/2004 Baerlocher et al. ..... 463/25
6,676,522 B2 1/2004 Rowe et al. ..... 463/42
6,685,564 B2 2/2004 Oliver ..... 463/25
6,685,568 B2 2/2004 Soltys et al. ..... 463/47
6,688,979 B2 2/2004 Soltys et al. ..... 463/25
6,698,756 B1 3/2004 Baker et al. ..... 273/149 R
6,698,759 B2 3/2004 Webb et al. ..... 273/292
6,712,693 B1 3/2004 Hettinger ..... 463/20
6,712,696 B2 3/2004 Soltys et al. ..... 463/25

| | | | | |
|---|---|---|---|---|
| 6,719,288 | B2 | 4/2004 | Hessing et al. | 273/149 R |
| 6,726,205 | B1 | 4/2004 | Purton | 273/148 R |
| 6,728,740 | B2 | 4/2004 | Kelly et al. | 708/250 |
| 6,729,956 | B2 | 5/2004 | Wolf et al. | 463/25 |
| 6,729,961 | B1 | 5/2004 | Millerschone | 463/30 |
| 6,736,250 | B2 | 5/2004 | Mattice | 194/203 |
| 6,745,330 | B1 | 6/2004 | Maillot | 713/200 |
| 6,752,312 | B1 | 6/2004 | Chamberlain et al. | 235/375 |
| 6,755,741 | B1 | 6/2004 | Rafaeli | 463/25 |
| 6,758,751 | B2 | 7/2004 | Soltys et al. | 463/29 |
| 6,817,948 | B2 | 11/2004 | Pascal et al. | 463/42 |
| 6,848,994 | B1 | 2/2005 | Knust et al. | 463/25 |
| 6,857,961 | B2 | 2/2005 | Soltys et al. | 463/47 |
| 6,889,979 | B2 | 5/2005 | Blaha et al. | 273/149 R |
| 6,896,618 | B2 | 5/2005 | Benoy et al. | 463/25 |
| 6,923,719 | B2 | 8/2005 | Wolf | 463/16 |
| 6,955,599 | B2 | 10/2005 | Bourbour et al. | 463/13 |
| 6,964,612 | B2 | 11/2005 | Soltys et al. | 463/47 |
| 6,991,544 | B2 | 1/2006 | Soltys et al. | 463/42 |
| 7,011,309 | B2 | 3/2006 | Soltys et al. | 273/149 R |
| 7,029,009 | B2 | 4/2006 | Grauzer et al. | 273/149 P |
| 7,036,818 | B2 | 5/2006 | Grauzer et al. | 273/149 R |
| 7,073,791 | B2 | 7/2006 | Grauzer et al. | 273/149 R |
| 7,137,627 | B2 | 11/2006 | Grauzer et al. | 273/149 R |
| 7,255,344 | B2 | 8/2007 | Grauzer et al. | 273/149 R |
| 2002/0063389 | A1 | 5/2002 | Breeding et al. | 273/292 |
| 2002/0084587 | A1 | 7/2002 | Bennett et al. | 273/309 |
| 2002/0147042 | A1 | 10/2002 | Vuong et al. | 463/40 |
| 2002/0163125 | A1 | 11/2002 | Grauzer et al. | 273/149 R |
| 2002/0187821 | A1 | 12/2002 | Soltys et al. | 463/11 |
| 2002/0187825 | A1* | 12/2002 | Tracy et al. | 463/17 |
| 2003/0032474 | A1 | 2/2003 | Kaminkow | 463/25 |
| 2003/0036425 | A1 | 2/2003 | Kaminkow et al. | 463/25 |
| 2003/0064774 | A1 | 4/2003 | Fujimoto et al. | 463/16 |
| 2003/0064798 | A1 | 4/2003 | Grauzer et al. | 463/29 |
| 2003/0083126 | A1 | 5/2003 | Paulsen | 463/25 |
| 2003/0090059 | A1 | 5/2003 | Grauzer et al. | |
| 2003/0176209 | A1 | 9/2003 | Soltys et al. | 463/13 |
| 2003/0195037 | A1 | 10/2003 | Vuong et al. | 463/29 |
| 2003/0212597 | A1 | 11/2003 | Ollins | 705/14 |
| 2003/0220136 | A1 | 11/2003 | Soltys et al. | 463/25 |
| 2003/0224858 | A1* | 12/2003 | Yoseloff et al. | 463/43 |
| 2004/0005920 | A1 | 1/2004 | Soltys et al. | 463/25 |
| 2004/0033095 | A1 | 2/2004 | Saffari et al. | 400/120.01 |
| 2004/0043820 | A1 | 3/2004 | Schlottmann | 463/43 |
| 2004/0067789 | A1 | 4/2004 | Grauzer et al. | 463/11 |
| 2004/0100026 | A1 | 5/2004 | Haggard | 273/304 |
| 2004/0108255 | A1 | 6/2004 | Johnson | 209/547 |
| 2004/0108654 | A1 | 6/2004 | Grauzer et al. | 273/148 R |
| 2004/0169332 | A1 | 9/2004 | Grauzer et al. | 273/149 R |
| 2004/0207156 | A1 | 10/2004 | Soltys et al. | 273/292 |
| 2004/0219982 | A1 | 11/2004 | Khoo et al. | 463/42 |
| 2004/0224777 | A1 | 11/2004 | Smith et al. | 463/47 |
| 2004/0229682 | A1 | 11/2004 | Gelinotte | 463/25 |
| 2005/0012270 | A1 | 1/2005 | Schubert et al. | 273/149 R |
| 2005/0023752 | A1 | 2/2005 | Grauzer et al. | 273/149 R |
| 2005/0026680 | A1 | 2/2005 | Gururajan | 463/25 |
| 2005/0026681 | A1 | 2/2005 | Grauzer et al. | 463/29 |
| 2005/0026682 | A1 | 2/2005 | Grauzer et al. | 463/29 |
| 2005/0040594 | A1 | 2/2005 | Krenn et al. | 273/149 R |
| 2005/0051955 | A1 | 3/2005 | Schubert et al. | 273/149 R |
| 2005/0051965 | A1 | 3/2005 | Gururajan | 273/292 |
| 2005/0054408 | A1 | 3/2005 | Steil et al. | 463/11 |
| 2005/0059479 | A1 | 3/2005 | Soltys et al. | 463/29 |
| 2005/0062226 | A1 | 3/2005 | Schubert et al. | 273/149 R |
| 2005/0062227 | A1 | 3/2005 | Grauzer et al. | 273/149 R |
| 2005/0073102 | A1 | 4/2005 | Yoseloff et al. | 273/292 |
| 2005/0093230 | A1 | 5/2005 | Grauzer et al. | 273/149 R |
| 2005/0101367 | A1 | 5/2005 | Soltys et al. | 463/12 |
| 2005/0116020 | A1 | 6/2005 | Smolucha et al. | 235/375 |
| 2005/0121852 | A1 | 6/2005 | Soltys et al. | 273/149 P |
| 2005/0137005 | A1 | 6/2005 | Soltys et al. | 463/13 |
| 2005/0156318 | A1 | 7/2005 | Douglas | 257/761 |
| 2005/0164761 | A1 | 7/2005 | Tain | 463/13 |
| 2005/0258597 | A1 | 11/2005 | Soltys et al. | 273/274 |
| 2005/0288083 | A1 | 12/2005 | Downs, III | 463/11 |
| 2005/0288084 | A1 | 12/2005 | Schubert | 463/11 |
| 2005/0288085 | A1 | 12/2005 | Schubert et al. | 463/11 |
| 2006/0001217 | A1 | 1/2006 | Soltys et al. | 273/292 |
| 2006/0019739 | A1 | 1/2006 | Soltys et al. | 273/292 |
| 2006/0019745 | A1 | 1/2006 | Benbrahim | 463/29 |

FOREIGN PATENT DOCUMENTS

| | | | |
|---|---|---|---|
| DE | 197 48 930 | A1 | 5/1998 |
| EP | 0 327 069 | A2 | 8/1989 |
| EP | 0 790 848 | | 8/1997 |
| EP | 0 700 980 | B1 | 11/1999 |
| EP | 1 291 045 | A2 | 3/2003 |
| FR | 530732 | | 12/1921 |
| FR | 24238 | | 3/1922 |
| FR | 2 775 196 | | 8/1999 |
| GB | 2 246 520 | A | 2/1992 |
| GB | 2 370 791 | A | 7/2002 |
| GB | 2 380 143 | A | 4/2003 |
| GB | 2 382 034 | A | 5/2003 |
| WO | WO 96/03188 | | 2/1996 |
| WO | WO 96/36253 | | 11/1996 |
| WO | WO 97/13227 | | 4/1997 |
| WO | WO 99/43403 | | 9/1999 |
| WO | WO 00/22585 | | 4/2000 |
| WO | WO 02/05914 | A1 | 1/2002 |
| WO | WO 02/051512 | A2 | 7/2002 |
| WO | WO 03/004116 | A1 | 1/2003 |
| WO | WO 2006/039308 | A2 | 4/2003 |
| WO | WO 03/60846 | A2 | 7/2003 |

OTHER PUBLICATIONS

U.S. Appl. No. 10/902,436, filed Jul. 29, 2004, Soltys et al.
U.S. Appl. No. 10/962,166, filed Oct. 8, 2004, Soltys et al.
U.S. Appl. No. 11/030,609, filed Jan. 5, 2005, Soltys et al.
U.S. Appl. No. 11/059,743, filed Feb. 16, 2005, Soltys et al.
U.S. Appl. No. 11/112,793, filed Apr. 21, 2005, Soltys et al.
U.S. Appl. No. 11/337,375, filed Jan. 23, 2006, Soltys et al.
U.S. Appl. No. 11/352,416, filed Feb. 10, 2006, Soltys.
U.S. Appl. No. 11/408,862, filed Apr. 21, 2006, Soltys et al.
U.S. Appl. No. 11/428,240, filed Jun. 30, 2006, Fleckenstein.
U.S. Appl. No. 11/428,244, filed Jun. 30, 2006, Soltys.
U.S. Appl. No. 11/428,249, filed Jun. 30, 2006, Fleckenstein.
U.S. Appl. No. 11/428,253, filed Jun. 30, 2006, Fleckenstein.
U.S. Appl. No. 11/428,258, filed Jun. 30, 2006, Fleckenstein.
U.S. Appl. No. 11/428,264, filed Jun. 30, 2006, Soltys.
U.S. Appl. No. 11/428,286, filed Jun. 30, 2006, Soltys et al.
U.S. Appl. No. 11/478,360, filed Jun. 29, 2006, Fleckenstein.
U.S. Appl. No. 11/479,930, filed Jun. 30, 2006, Soltys et al.
U.S. Appl. No. 11/479,963, filed Jun. 29, 2006, Fleckenstein.
U.S. Appl. No. 11/479,991, filed Jun. 29, 2006, Soltys.
U.S. Appl. No. 11/479,988, filed Jun. 30, 2006, Shayesteh.
U.S. Appl. No. 11/480,273, filed Jun. 30, 2006, Soltys.
U.S. Appl. No. 11/480,274, filed Jun. 30, 2006, Huizinga.
U.S. Appl. No. 11/480,275, filed Jun. 30, 2006, Fleckenstein.
U.S. Appl. No. 11/480,295, filed Jun. 29, 2006, Fleckenstein.
U.S. Appl. No. 11/480,321, filed Jun. 30, 2006, Soltys.
U.S. Appl. No. 11/480,345, filed Jun. 30, 2006, Fleckenstein.
U.S. Appl. No. 11/480,349, filed Jun. 30, 2006, Soltys et al.
U.S. Appl. No. 11/519,244, filed Sep. 11, 2006, Soltys et al.
U.S. Appl. No. 60/554,090, filed Mar. 17, 2004, Soltys et al.
U.S. Appl. No. 60/838,280, filed Aug. 17, 2006, Soltys et al.
U.S. Appl. No. 60/847,331, filed Sep. 26, 2006, Shayesteh.
Bulavsky, J., "Tracking the Tables," *Casino Journal*, May 2004, pp. 44-47, accessed Dec. 21, 2005, URL=http://www.ascendgaming.com/cj/vendors_manufacturers_table/Trackin916200411141AM.htm, 5 pages.
Burke, A., "Tracking the Tables," reprinted from *International Gaming & Wagering Business*, Aug. 2003, 4 pages.

Griffin, P., *The Theory of Blackjack*, GBC Press, Las Vegas, Nevada, 1979, 190 pages.
Gros, R., "All You Ever Wanted to Know About Table Games," reprinted from *Global Gaming Business*, Aug. 1, 2003, 2 pages.
Pro, L.V., "Book Review—The Card Counter's Guide to Casino Surveillance," *Blackjack Insider Newsletter*, May 2003, #40, accessed Aug. 25, 2006, URL=http:/bjinsider.com/newsletter_40_surveillance.shtml, 5 pages.
Scarne, J., Scarne's Encyclopedia of Games, Harper & Row, New York, 1973, p. 153.
Scarne, J., *Scarne's New Complete Guide to Gambling*, Simon & Schuster, Inc., New York, 1974; pp. 358-359.
Snyder, A, "The High-Tech Eye," excerpt from *Blackjack Forum*, Spring 1997, accessed Dec. 21, 2005, from Casino Software & Services, LLC, URL=http://www.casinosoftware.com/bj_forum.html.
Terdiman, D., "Who's Holding the Aces Now?", reprinted from *Wired News*, Aug. 18, 2003, 2 pages.
Ward, K., "BJ Tracking System has Players Down for the Count," *Gaming Today*, Mar. 5, 2002, accessed Dec. 21, 2005, from Casino Software & Services, LLC, URL=http://www.casinosoftware.com/gaming_today.html.
Winkler, C., "Product Spotlight: MindPlay," reprinted from *Gaming and Leisure Technology*, Fall 2003, 2 pages..
Bally TMS, "MP21—Automated Table Tracking/Features," 2 pages, Nov. 2005.
Bally TMS, "MPBacc—Intelligent Table Tracking/Features," 2 pages, Nov. 2005.
Bally TMS, "MPBacc—Specifications/Specifications," 2 pages, Nov. 2005.
Bally TMS, "MPLite—Table Management System/Features," 2 pages, Nov. 2005.
Bravo Gaming Systems, "Casino Table Wager Analysis and Player Tracking System—Table Operations/Unique Features," accessed Apr. 11, 2005, URL=http://www.genesisgaming.com, 4 pages.
Casino Software & Services, LLC., accessed Aug. 25, 2006, URL=http:/casinosoftware.com/home.html, 6 pages.
*Gambling Magazine*, "Gaming Company Takes RFID to the Casino," Dec. 27, 2004, accessed Aug. 25, 2006, URL=http:/www.gamblingmagazine.com/managearticle.asp?C=290&A=13186, 4 pages.
International Guild of Hospitality & Restaurant Managers, "Shuffle Master, Inc. (NasdaqNM:SHFL)," accessed Dec. 30, 2003, URL=http://hospitalityguide.com/Financial/Casinos/Shuffle.htm, 3 pages.
Mikohn, "Mikohn Tablelink—The Industry's Premier Table Tracking Solution Delivers Improvements Straight to the Bottom Line," 2 pages, before Jan. 1, 2004.
Mikohn, "Tablelink™, The New Standard in Table Games," before Jan. 1, 2004, 14 pages.
Plaintiff's Declaration of Lawrence Luciano in Opposition to Shuffle Master's Motion for Preliminary Injuction, *Card, LLC* v. *Shuffle Master, Inc.*, D. Nev. (No. CV-N-03-0244-ECR-(RAM), Nov. 24, 2003.
Shuffle Master, Inc., "Shuffle Master Announces New Products; Intelligent Table System to Be Debuted at G2E," Sep. 10, 2003, 2 pages.
Shuffle Master, Inc., "Shuffle Master Gaming Presents The Ultimate Player Rating System . . . Bloodhound Sniffs Out the Pros and Cons," Dec. 31, 1997, 6 pages.
U.S. Appl. No. 11/558,409, filed Nov. 9, 2006, Soltys.
U.S Appl. No. 60/887,092, filed Jan. 29, 2007, Shayesteh.
English Translation of German Patent No. DE 197 48 930, publication date of May 14, 1998, inventor: Markeev.
Final Office Action issued on Jul. 25, 2008 in U.S. Appl. No. 10/962,166, filed Oct. 8, 2004.
US 6,599,191, 07/2003, Breeding et al. (withdrawn)

* cited by examiner

SYSTEMS, METHODS AND ARTICLES TO FACILITATE PLAYING CARD GAMES WITH SELECTABLE ODDS

CROSS-REFERENCES TO RELATED APPLICATIONS

This application is a continuation of U.S. patent application Ser. No. 10/017,276, filed Dec. 13, 2001, which claims the benefit under 35 U.S.C. §119(e) from U.S. Provisional Patent Application No. 60/296,866, filed Jun. 8, 2001.

BACKGROUND

1. Field

This disclosure is generally related to games of skill and chance, and in particular to distributing playing cards for card games.

2. Description of the Related Art

Card games are a well-known form of recreation and entertainment. Games are typically played with one or more decks of cards, where each deck typically includes 52 cards. Each deck of cards will typically include four suits of cards, including: hearts, diamonds, clubs, and spades, each suit including fourteen cards having rank: 2-10, Jack, Queen, King and Ace. Card games may, or may not, include wagering based on the game's outcome.

Decks of playing cards must be periodically shuffled to prevent the same card hands from continually reappearing. Shuffling may take place after every card in the deck or decks has been dealt, for example after several hands have been played. Shuffling may also interfere with, and even prevent, a player from gaining an unfair advantage over the house or other players by counting cards. Numerous card counting systems are known, and typically rely on a player keeping a mental count of some or all of the cards which have been played. For example, in the game of twenty-one or "blackjack" it is beneficial to determine when all cards with a rank of 5 have been dealt (i.e., fives strategy). Tens strategy is another card counting method useful in the game of twenty-one. In tens strategy, the player increments a count each time a card having a value of 10 appears, and decrements the count when card having a value less than appears. The count may be divided by the total number of cards remaining to be dealt to give the player an indication of how much the remaining deck favors the player with respect to the house. Other variations of card counting are well known in the art.

Manual shuffling tends to slow play down, so the gaming industry now employs numerous mechanical shufflers to speed up play and to more thoroughly shuffle the cards. The cards are typically shuffled several cards before the end of the deck(s), in an effort to hinder card counting, which may be particularly effective when only a few hands of cards remain (i.e., end game strategy). The ratio of the number of cards dealt to the total number of cards remaining in the deck(s) is commonly known as the penetration. The gaming industry is now introducing continuous shufflers in a further attempt to frustrate attempts at card counting. As the name implies, continuous shufflers mechanically shuffle the cards remaining to be dealt while one or more hands are being played.

While mechanical shufflers increase the speed of play and produce a more through shuffle over manual methods, there is still a need for improve in speed and/or thoroughness of the shuffle. In particular, mechanical shuffling methods are subject to incomplete shuffles due to the inherently mechanical nature of such devices. Additionally, mechanical shufflers are limited in the total number of decks they can manipulate.

BRIEF SUMMARY

In one embodiment, a gaming system comprises an input device operable to receive selections indicative of at least one of a set of odds or a house advantage for at least one hand to be played by at least one player of a card game; and a playing card handling system responsive to the selections received at the input device to provide the at least one hand of playing cards, where the playing cards forming the at least one hand correspond to at least one set of playing card values pseudo-randomly generated based at least in part on the received selections indicative of the at least one of the set of odds or the house advantage.

In another embodiment, a method of operating a gaming system comprises receiving selections indicative of at least one of a set of odds or a house advantage for at least one hand to be played by at least one player of a card game; and providing the at least one hand of playing cards, where the playing cards forming the at least one hand correspond to a set of playing card values pseudo-randomly generated at least in part based on the received selection indicative of at least one of the set of odds or the house advantage.

In another embodiment, a gaming system comprises at least one input device operable to receive selections indicative of respective sets of odds for each of a number of hands of cards to be played during of a card game; and at least one display responsive to the at least one input device to display respective payout odds for each of the hands of playing cards to be played during a card game.

In another embodiment, a method of operating a gaming system comprises receiving selections indicative of respective sets of odds for each of a number of hands of cards to be played during of a card game; and displaying payout odds for each of the hands of playing cards to be played during a card game based at least in part on the received selections.

BRIEF DESCRIPTION OF THE SEVERAL VIEWS OF THE DRAWINGS

In the drawings, identical reference numbers identify similar elements or acts. The sizes and relative positions of elements in the drawings are not necessarily drawn to scale. For example, the shapes of various elements and angles are not drawn to scale, and some of these elements are arbitrarily enlarged and positioned to improve drawing legibility. Further, the particular shapes of the elements as drawn, are not intended to convey any information regarding the actual shape of the particular elements, and have been solely selected for ease of recognition in the drawings.

DETAILED DESCRIPTION

In the following description, certain specific details are set forth in order to provide a thorough understanding of various embodiments. However, one skilled in the art will understand that some embodiments may be practiced without these details. In other instances, well-known structures associated with computers, servers, networks, imagers, and gaming or wagering apparatus have not been shown or described in detail to avoid unnecessarily obscuring descriptions of the embodiments.

Unless the context requires otherwise, throughout the specification and claims which follow, the word "comprise" and variations thereof, such as, "comprises" and "comprising" are to be construed in an open, inclusive sense, that is as "including, but not limited to."

The headings and Abstract of the Disclosure provided herein are for convenience only and do not interpret the scope or meaning of the claims.

Wagering Environment Overview

Figure 1:
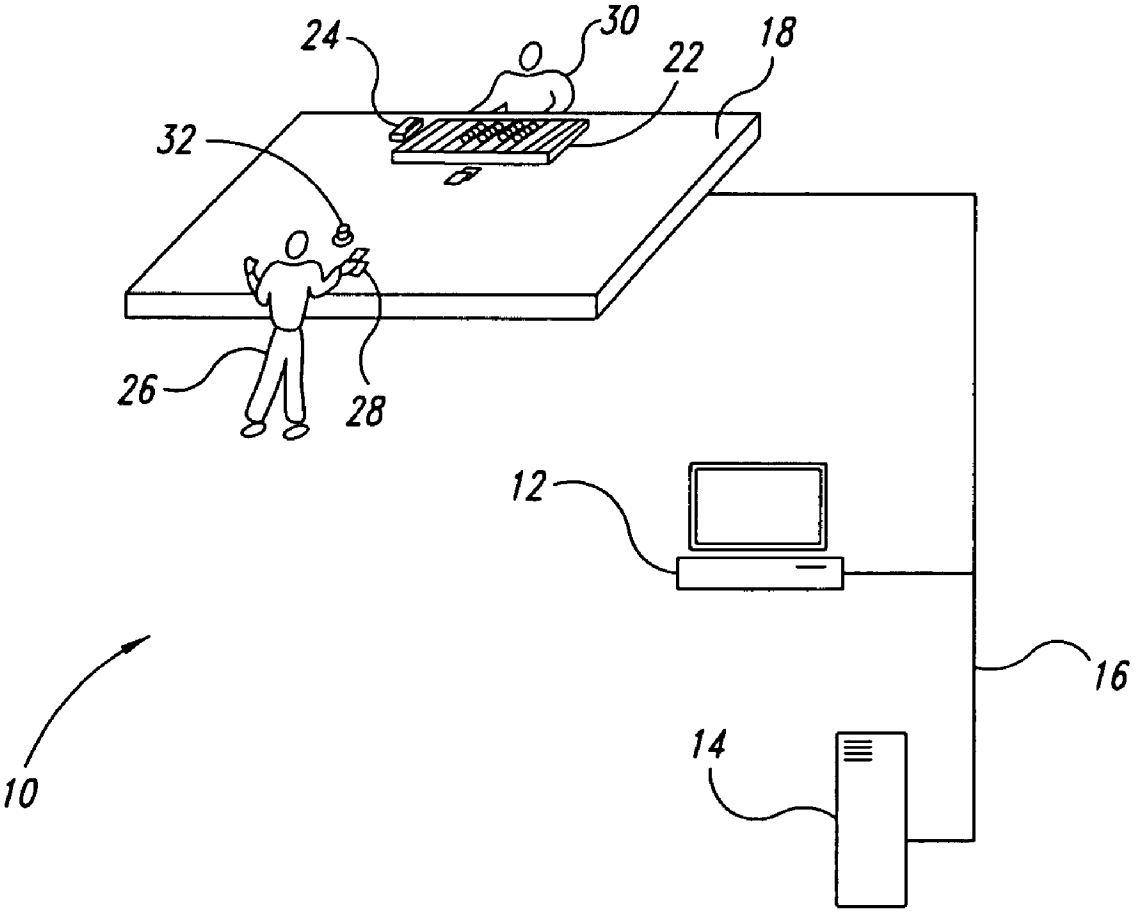
FIG. 1 is an isometric view of a networked automatic wager monitoring system in a gaming environment, including a networked playing card distribution device according to one illustrated embodiment.

FIG. 1 shows a networked automated wager monitoring system 10 including a host computing system 12, a server 14 and a network 16. The server 14 and network 16 couple the host computing system 12 to various gaming sensors, gaming actuators and/or gaming processors at a number of different wagering or gaming tables, such as a twenty-one or blackjack table 18.

In one embodiment, the host computing system 12 acts as a central computing system, interconnecting the gaming tables of one or more casinos. In an alternative embodiment, the host computing system 12 is associated with a single gaming table, or a small group of gaming tables. In a further alternative, the host computing system 12 is associated with a single gaming table or group of gaming tables and is interconnected with other host computing systems.

The gaming sensors, gaming actuators and/or gaming processors and other electronics can be located in the gaming table, and/or various devices on the gaming table such as a chip tray 22 and/or a card distribution device 24. For example, suitable hardware and software for playing card based games such as twenty-one are described in commonly assigned pending U.S. patent applications: Ser. No. 60/130,368, filed Apr. 21, 1999; Ser. No. 09/474,858, filed Dec. 30, 1999, entitled "METHOD AND APPARATUS FOR MONITORING CASINO GAMING"; Ser. No. 60/259,658, filed Jan. 4, 2001; Ser. No. 09/849,456, filed May 4, 2001; and Ser. No. 09/790,480, filed Feb. 21, 2001, entitled "METHOD, APPARATUS AND ARTICLE FOR EVALUTING CARD GAMES, SUCH AS BLACKJACK".

A player 26 can place a wager on the outcome of the gaming event, such as the outcome of a hand of playing cards 28 dealt by a dealer 30 in a game of twenty-one. The player 26 may place the wager by locating wagering pieces such as one or more chips 32 in an appropriate location on the blackjack table 18.

Figure 2:
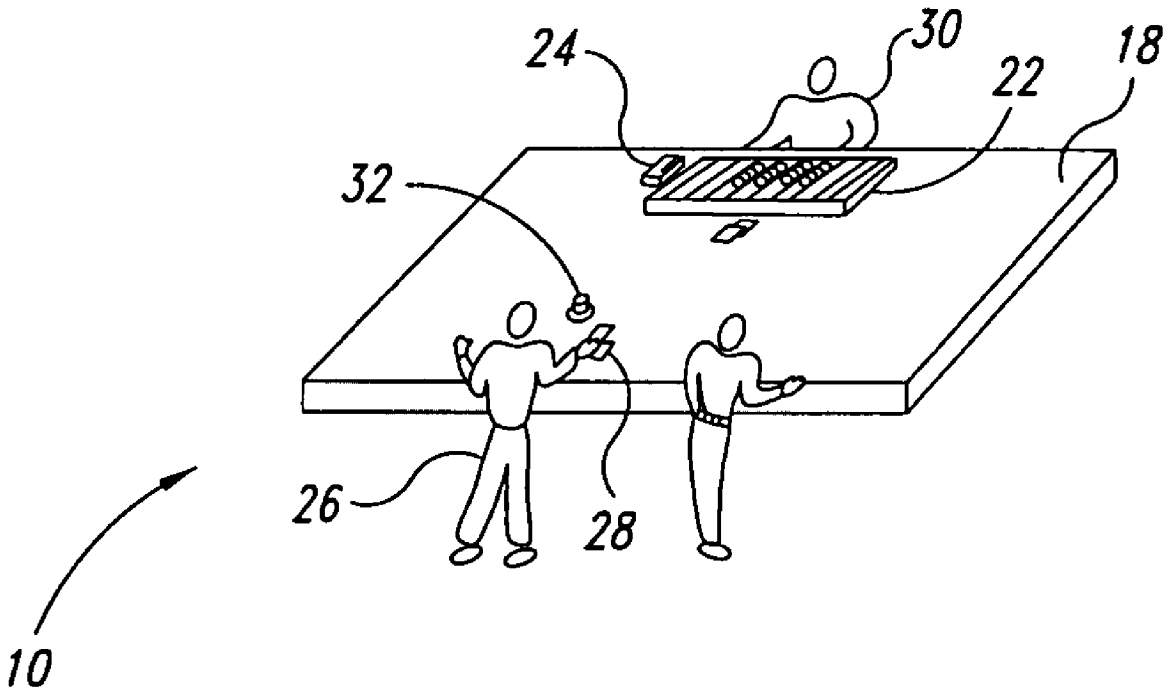
FIG. 2 is an isometric view of a gaming table, including a standalone playing card distribution device according to another illustrated embodiment.

FIG. 2 shows an alternative embodiment of the gaming table 18. This alternative embodiment, and those alternative embodiments and other alternatives described herein, are substantially similar to previously described embodiments, and common acts and structures are identified by the same reference numbers. Only significant differences in operation and structure are described below.

In FIG. 2, the gaming table 18 includes a standalone version of the card distribution device 24, and otherwise does not employ the electronics of FIG. 1. Thus, the dealer and/or pit boss manually monitors the game play and wagering.

System Hardware

Figure 3:
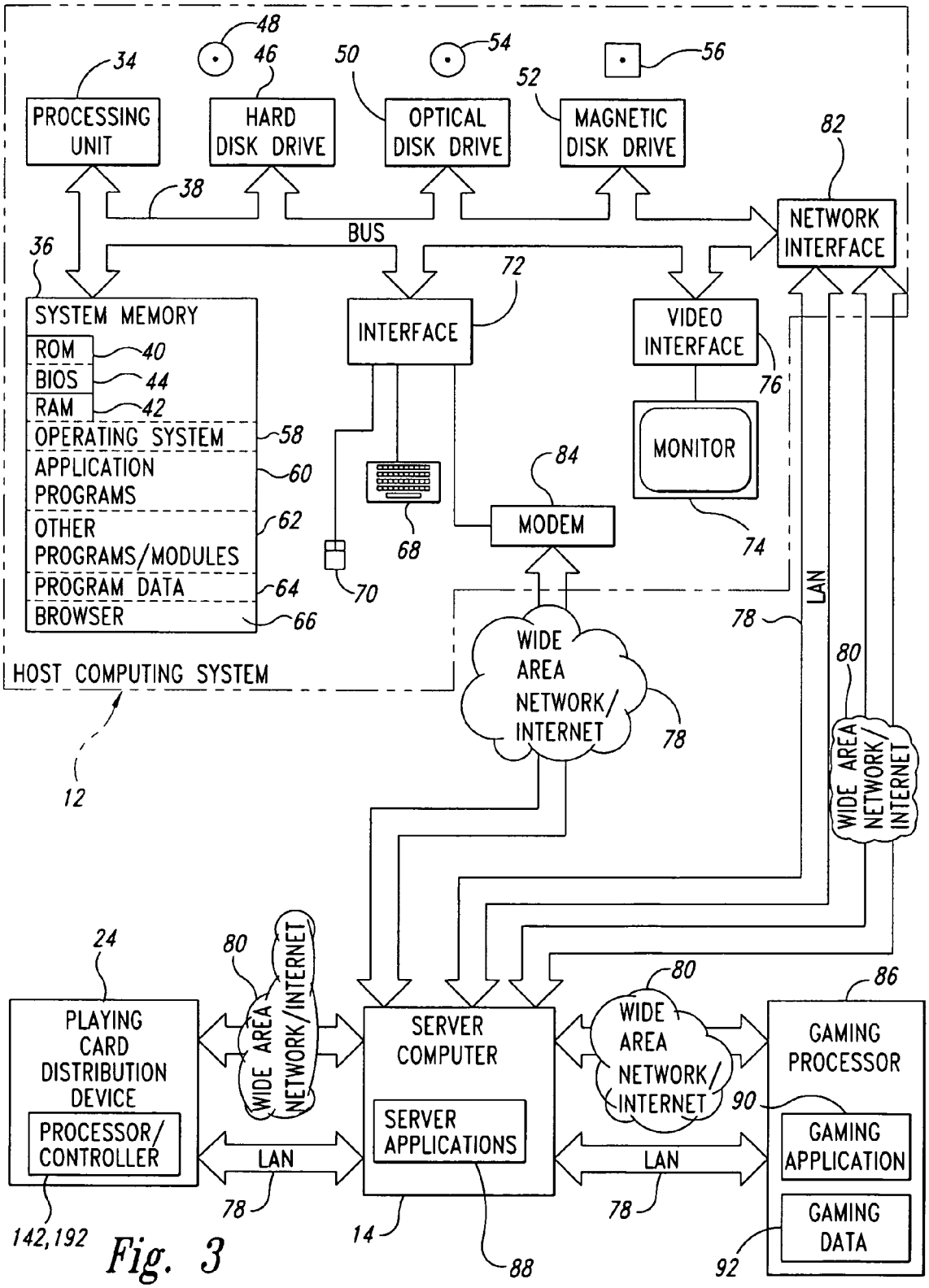
FIG. 3 is a functional block diagram of the networked automatic wager monitoring system of FIG. 1.

FIG. 3 and the following discussion provide a brief, general description of a suitable computing environment in which embodiments can be implemented, particularly those of FIG. 1. Although not required, embodiments will be described in the general context of computer-executable instructions, such as program application modules, objects, or macros being executed by a computer. Those skilled in the relevant art will appreciate that the embodiments can be practiced with other computer system configurations, including hand-held devices, multiprocessor systems, microprocessor-based or programmable consumer electronics, personal computers ("PCs"), network PCs, mini computers, mainframe computers, and the like. The embodiments can be practiced in distributed computing environments where tasks or modules are performed by remote processing devices, which are linked through a communications network. In a distributed computing environment, program modules may be located in both local and remote memory storage devices.

Referring to FIG. 1, a conventional mainframe or minicomputer, referred to herein as the host computing system 12, includes a processing unit 34, a system memory 36 and a system bus 38 that couples various system components including the system memory 36 to the processing unit 34. The host computing system 12 will at times be referred to in the singular herein, but this is not intended to limit the application of the embodiments to a single host computer since in typical embodiments, there will be more than one host computer or other device involved. The automated wager monitoring system 10 may employ other computers, such as conventional personal computers, where the size or scale of the system allows. The processing unit 34 may be any logic processing unit, such as one or more central processing units (CPUs), digital signal processors (DSPs), application-specific integrated circuits (ASICs), etc. Unless described otherwise, the construction and operation of the various blocks shown in FIG. 1 are of conventional design. As a result, such blocks need not be described in further detail herein, as they will be understood by those skilled in the relevant art.

The system bus 38 can employ any known bus structures or architectures, including a memory bus with memory controller, a peripheral bus, and a local bus. The system memory 36 includes read-only memory ("ROM") 40 and random access memory ("RAM") 42. A basic input/output system ("BIOS") 44, which can form part of the ROM 40, contains basic routines that help transfer information between elements within the host computing system 12, such as during start-up.

The host computing system 12 also includes a hard disk drive 46 for reading from and writing to a hard disk 48, and an optical disk drive 50 and a magnetic disk drive 52 for reading from and writing to removable optical disks 54 and magnetic disks 56, respectively. The optical disk 54 can be a CD-ROM, while the magnetic disk 56 can be a magnetic floppy disk or diskette. The hard disk drive 46, optical disk drive 50 and magnetic disk drive 52 communicate with the processing unit 34 via the bus 38. The hard disk drive 46, optical disk drive 50 and magnetic disk drive 52 may include interfaces or controllers (not shown) coupled between such drives and the bus 38, as is known by those skilled in the relevant art. The drives 46, 50 and 52, and their associated computer-readable media, provide nonvolatile storage of computer readable instructions, data structures, program modules and other data for the host computing system 12. Although the depicted host computing system 12 employs hard disk 46, optical disk 50 and magnetic disk 52, those skilled in the relevant art will appreciate that other types of computer-readable media that can store data accessible by a computer may be employed, such as magnetic cassettes, flash memory cards, digital video disks ("DVD"), Bernoulli cartridges, RAMs, ROMs, smart cards, etc.

Program modules can be stored in the system memory 36, such as an operating system 58, one or more application programs 60, other programs or modules 62 and program data 64. The system memory 36 may also include a Web client or browser 66 for permitting the host computing system 12 to access and exchange data with sources such as web sites of the Internet, corporate intranets, or other networks as described below, as well as other server applications on server computers such as those further discussed below. The browser 66 in the depicted embodiment is markup language based, such as Hypertext Markup Language (HTML), Extensible Markup Language (XML) or Wireless Markup Language (WML), and operates with markup languages that use syntactically delimited characters added to the data of a document to represent the structure of the document. A number of Web clients or browsers are commercially available such as NETSCAPE NAVIGATOR from America Online, and INTERNET EXPLORER available from Microsoft of Redmond, Wash.

While shown in FIG. 1 as being stored in the system memory 36, the operating system 58, application programs 60, other programs/modules 62, program data 64 and browser 66 can be stored on the hard disk 48 of the hard disk drive 46, the optical disk 54 of the optical disk drive 50 and/or the magnetic disk 56 of the magnetic disk drive 52. An operator, such as casino personnel, can enter commands and information into the host computing system 12 through input devices such as a keyboard 68 and a pointing device such as a mouse 70. Other input devices can include a microphone, joystick, game pad, scanner, etc. These and other input devices are connected to the processing unit 34 through an interface 72 such as a serial port interface that couples to the bus 38, although other interfaces such as a parallel port, a game port or a wireless interface or a universal serial bus ("USB") can be used. A monitor 74 or other display device is coupled to the bus 38 via a video interface 76, such as a video adapter. The host computing system 12 can include other output devices, such as speakers, printers, etc.

The host computing system 12 can operate in a networked environment using logical connections to one or more remote computers, such as the server computer 14. The server computer 14 can be another personal computer, a server, another type of computer, or a collection of more than one computer communicatively linked together and typically includes many or all of the elements described above for the host computing system 12. The server computer 14 is logically connected to one or more of the host computing systems 12 under any known method of permitting computers to communicate, such as through a local area network ("LAN") 78, or a wide area network ("WAN") or the Internet 80. Such networking environments are well known in wired and wireless enterprise-wide computer networks, intranets, extranets, and the Internet. Other embodiments include other types of communication networks including telecommunications networks, cellular networks, paging networks, and other mobile networks.

When used in a LAN networking environment, the host computing system 12 is connected to the LAN 78 through an adapter or network interface 82 (communicatively linked to the bus 38). When used in a WAN networking environment, the host computing system 12 may include a modem 84 or other device, such as the network interface 82, for establishing communications over the WAN/Internet 80. The modem 84 is shown in FIG. 1 as communicatively linked between the interface 72 and the WAN/Internet 78. In a networked environment, program modules, application programs, or data, or portions thereof, can be stored in the server computer 14. In the depicted embodiment, the host computing system 12 is communicatively linked to the server computer 14 through the LAN 78 or the WAN/Internet 80 with TCP/IP middle layer network protocols; however, other similar network protocol layers are used in other embodiments, such as User Datagram Protocol ("UDP"). Those skilled in the relevant art will readily recognize that the network connections shown in FIG. 1 are only some examples of establishing communication links between computers, and other links may be used, including wireless links.

The server computer 14 is communicatively linked to the sensors, actuators, and gaming processors 86 of one or more gaming tables 18, typically through the LAN 78 or the WAN/Internet 80 or other networking configuration such as a direct asynchronous connection (not shown). The server computer 14 is also communicatively linked to the card distribution device 24, typically through the LAN 78 or the WAN/Internet 80 or other networking configuration such as a direct asynchronous connection (not shown).

The server computer 14 includes server applications 88 for the routing of instructions, programs, data and agents between the gaming processors 86 and the host computing system 12. For example the server applications 88 may include conventional server applications such as WINDOWS NT 4.0 Server, and/or WINDOWS 2000 Server, available from Microsoft Corporation or Redmond, Wash. Additionally, or alternatively, the server applications 88 can include any of a number of commercially available Web servers, such as INTERNET INFORMATION SERVICE from Microsoft Corporation and/or IPLANET from Netscape.

The gaming processor 86 can include gaming applications 90 and gaming data 92. The gaming applications 90 can include instructions for acquiring wagering and gaming event information from the live gaming at the game position, such as instructions for acquiring an image of the wagers and identifiers on playing cards. The gaming applications 90 can also include instructions for processing, at least partially, the acquired wagering and gaming event information, for example, identifying the position and size of each wager and/or the value of each hand of playing cards. Suitable applications are described in one or more of commonly assigned U.S. patent applications: Ser. No. 60/64368, filed Apr. 21, 1999; Ser. No. 09/474,858 filed Dec. 30, 1999, entitled "METHOD AND APPARATUS FOR MONITORING CASINO GAMING"; Ser. No. 60/259,658, filed Jan. 4, 2001; Ser. No. 09/849,456 filed May 4, 2001, Ser. No. 09/790,480, filed Feb. 21, 2001, entitled "METHOD, APPARATUS AND ARTICLE FOR EVALUTING CARD GAMES, SUCH AS BLACKJACK".

Additionally, the gaming applications 90 may include statistical packages for producing statistical information regarding the play at a particular gaming table, the performance of one or more players, and/or the performance of the dealer 30 and/or game operator 66. The gaming applications 90 can also include instructions for providing a video feed of some or all of the gaming position. Gaming data may include outcomes of games, amounts of wagers, average wager, player identity information, complimentary benefits information ("comps"), player performance data, dealer performance data, chip tray accounting information, playing card sequences, etc. The gaming applications 90 can further include instructions for handling security such as password or other access protection and communications encryption. Thus, the server 12 can route wagering related information between the gaming tables and the host computing system 12.

Card Distribution Devices

Figure 4:
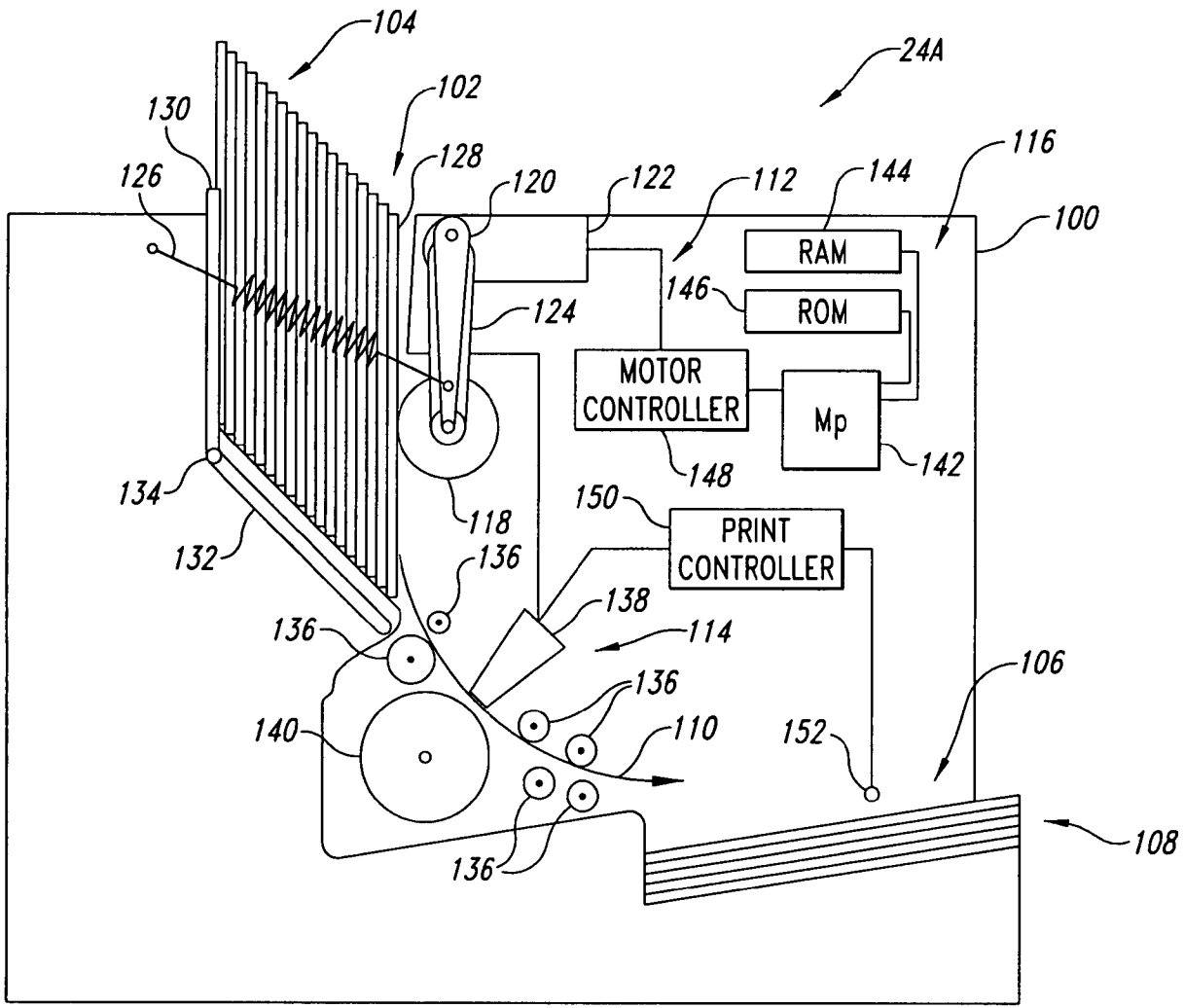
FIG. 4 is a cross-sectional diagram of one embodiment of the playing card distribution device in the form of a card printing device, particularly suited for the standalone operation of FIG. 2.

FIG. 4 shows one embodiment of the card distribution device 24, in the form of a first card printing device 24A.

The first card printing device 24A includes a housing 100 having a card receiver 102 for receiving playing card blanks 104, a card holder 106 for holding printed playing cards 108, and a card path identified by arrow 110 extending between the card receiver 102 and card holder 106. While shown as separate receptacles 102, 106, some embodiments of the card printing device 24A may employ a single receptacle both receiving the playing card blanks 104 and the printed playing cards 108. The first card printing device 24A generally includes a drive mechanism 112, a print mechanism 114 and a control mechanism 116.

As illustrated in FIG. 4, the drive mechanism 112 includes a drive roller 118 rotatably mounted at the end of a pivot arm 120 and driven by a motor 122 via a drive belt 124. The motor 122 can take the form of a stepper motor, that drives the drive roller 118 in small increments or steps, such that the card blank 104 is propelled incrementally or stepped through the card path 110 of the card distribution device 24A, pausing slightly between each step. Stepper motors and their operation are well known in the art. A spring 126 biases the pivot arm 120 toward the card blanks 104 to maintain contact between the drive roller 118 and an outside one 128 of the card blanks 104 in the card receiver 102. Thus, as the drive roller 118 rotates (counterclockwise with respect to the Figure), the outside card blank 128 is propelled along the card path 110. Additionally, or alternatively, a card support 130 positioned behind the card blanks 104 is supported along an inclined plane such as a guide channel 132 by one or more rollers 134. The weight of the card support 130 and or an additional attached weight (not shown) biases the card support 130 and the card blanks 104 toward the card path 110. The drive mechanism 112 also includes a number of guide rollers 136 to guide the card blank 104 along the card path 110. Typically the guide rollers 136 are not driven, although in some embodiments one or more of the guide rollers 136 can be driven where suitable. For example, one or more guide rollers 136 may be driven where the card path 110 is longer than the length of the card blank 104. While a particular drive mechanism 112 is illustrated, many other suitable drive mechanisms will be apparent to those skilled in the art of printing. Reference can be made to the numerous examples of drive mechanisms for both impact and non-impact printers.

The printing mechanism 114 includes a print head 138 and a platen 140. The print head 138 can take any of a variety of forms, such as a thermal print head, ink jet print head, electrostatic print head, or impact print head. The platen 140, by itself or with one or more of the guide rollers 136 (i.e., "bail rollers"), provides a flat printing surface on a card blank 104 positioned under the print head 138. While illustrated as a platen roller 140, the first card printing device 24A can alternatively employ a stationary platen where suitable for the particular card stock and print head 138. In an alternative embodiment, the platen roller 140 may be driven by the motor 122, or by a separate motor.

The control mechanism 116 includes a microprocessor 142, volatile memory such as a Random Access Memory ("RAM") 144, and a persistent memory such as a Read Only Memory ("ROM") 146. The microprocessor 142 executes instructions stored in RAM 144, ROM 146 and/or the microprocessor's 142 own onboard registers (not shown) for generating a random playing card sequence, and printing the appropriate markings on the playing cards in the order of the random playing card sequence. The control mechanism 116 also includes a motor controller 148 for controlling the motor 112 in response to motor control signals from the microprocessor 142, and a print controller 150 for controlling the print head 138 in response to print control signals from the microprocessor 142.

The control mechanism 116 may further include a card level detector 152 for detecting a level or number of playing cards in the playing card holder 106. The card level detector 152 can include a light source and receiver pair and a reflector spaced across the playing card holder from the light source and receiver pair. Thus, when the level of playing cards 108 in the card holder 106 drops below the path of the light, the card level detector 152 detects light reflected by the reflector, and provides a signal to the microprocessor 142 indicating that additional playing cards 108 should be printed. The printing device 24B can employ other level detectors, such as mechanical detectors.

In operation the microprocessor 142 executes instructions stored in the RAM 144, ROM 147 and/or microprocessor's registers to computationally generate a random playing card sequence from a set of playing card values. Random number generation on computers is well known in the computing arts. Mathematicians do not generally consider computer generated random numbers to be truly random, and thus commonly refer to such numbers as being pseudo-random. However such numbers are sufficiently random for most practical purposes, such as distributing playing cards to players. Hence, while we denominate the computer generated values as being pseudo-random, such term as used herein and in the claims should include any values having a suitable random distribution, whether truly mathematically random or not.

The microprocessor 142 generates print data based on the computationally generated random playing card sequence. The print data consists of instructions for printing markings on respective ones of the playing card blanks 104 that correspond to respective playing card values from the random playing card sequence. For example, the print data can identify which elements of the print head 138 to activate at each step of the motor 122 to print a desired image. During each pause between steps of the motor 122, a small portion of the card blank 104 is aligned with the print head 138 and selected elements of the print head 138 are activated to produce a portion of an image on the portion of the card blank 104 aligned with the print head 138. The image portion is a small portion of an entire image to be printed. The entire image typically is produced by stepping the card blank 104 past the print head 138, pausing the card blank 104 after each step, determining the portion of the image corresponding to the step number, determining which elements of the print head 138 to activate to produce the determined portion of the image, and activating the determined elements to produce the determined portion of the image on the card blank 104. The microprocessor 142 provides the print data as motor commands to the motor controller 148 and as print commands to the print controller 150, for respectively synchronizing and controlling the motor 122 and print head 138.

Thus, the card printing device 24A of FIG. 4 provides a standalone card distribution device for printing playing cards in a pseudo-random sequence, which may be used at any gaming position. Since the first card printing device 24A includes a microprocessor 142, the first card printing device 24A is particularly suited for the manually monitored gaming table 18 of FIG. 2, where the card distribution device 24 operates in a standalone mode. However, the first card printing device 24A can operate as an integral portion of the automated wager monitoring system 10, or in conjunction with such a system 10.

Figure 5:
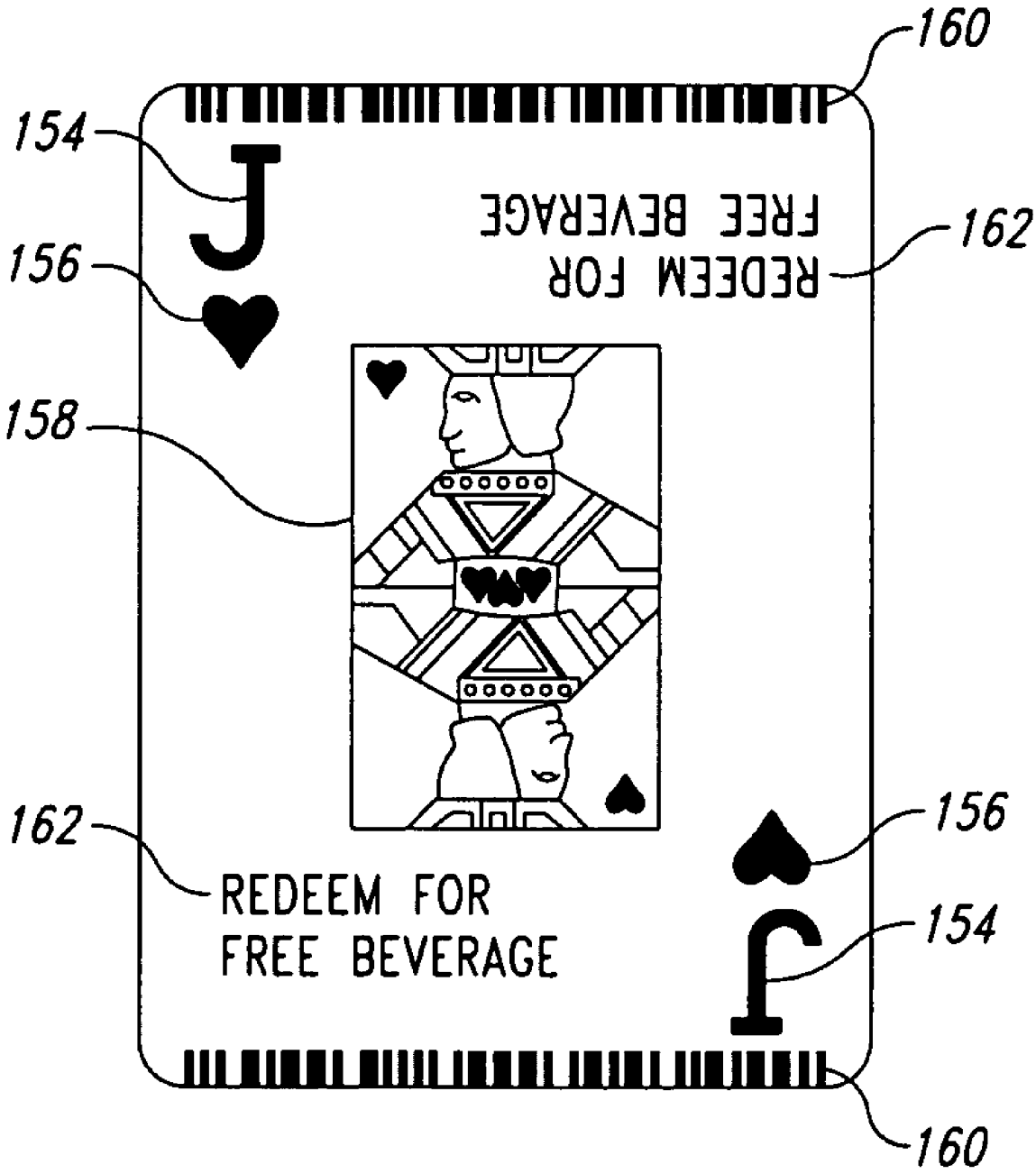
FIG. 5 is a front elevational view of a face of an exemplary playing card.

As shown in FIG. 5, the markings on the playing cards 108 (FIG. 4) may include the conventional symbols representing a rank (i.e., 2-10, Jack, Queen, King, Ace) 154 and a suit (i.e., Diamonds, Hearts, Spades and Clubs) 156 of the playing card (shown in FIG. 5). The markings can also include indicia such as the images of Jacks, Queens and Kings 158 commonly found on playing cards.

The markings may also include an identifier, for example a serial number that uniquely defines the particular playing, and/or playing card deck to which the playing card belongs. The identifier can take the form of a bar code, area code or stack code symbol 160 selected from a suitable machine-readable symbology, to allow easy machine recognition using standard readers. While visible in the illustration, the bar code symbols 160 can be printed with an ink that is only visible under a specific frequency of light, such as the UV range of the electromagnetic spectrum. This prevents players 26 from viewing the serial numbers during game play.

The markings can optionally include additional indicia such as advertising messages 162. The advertising messages 162 may be player or game specific, and may be provide to only specific players, to random players, and/or to all players. The advertising message 162 may take the form of promotions, for example, informing the player that the card may be redeemed for meals, beverages, accommodations, souvenirs, goods and/or services at casino facilities or other facilities. The inclusion of a serial number on the playing card, particularly a serial number encoded in machine-readable form 160 allows a promotional playing card 164 of the playing cards 108 to be easily verified using standard automatic data collection ("ADC") devices when presented for redemption.

Figure 6:
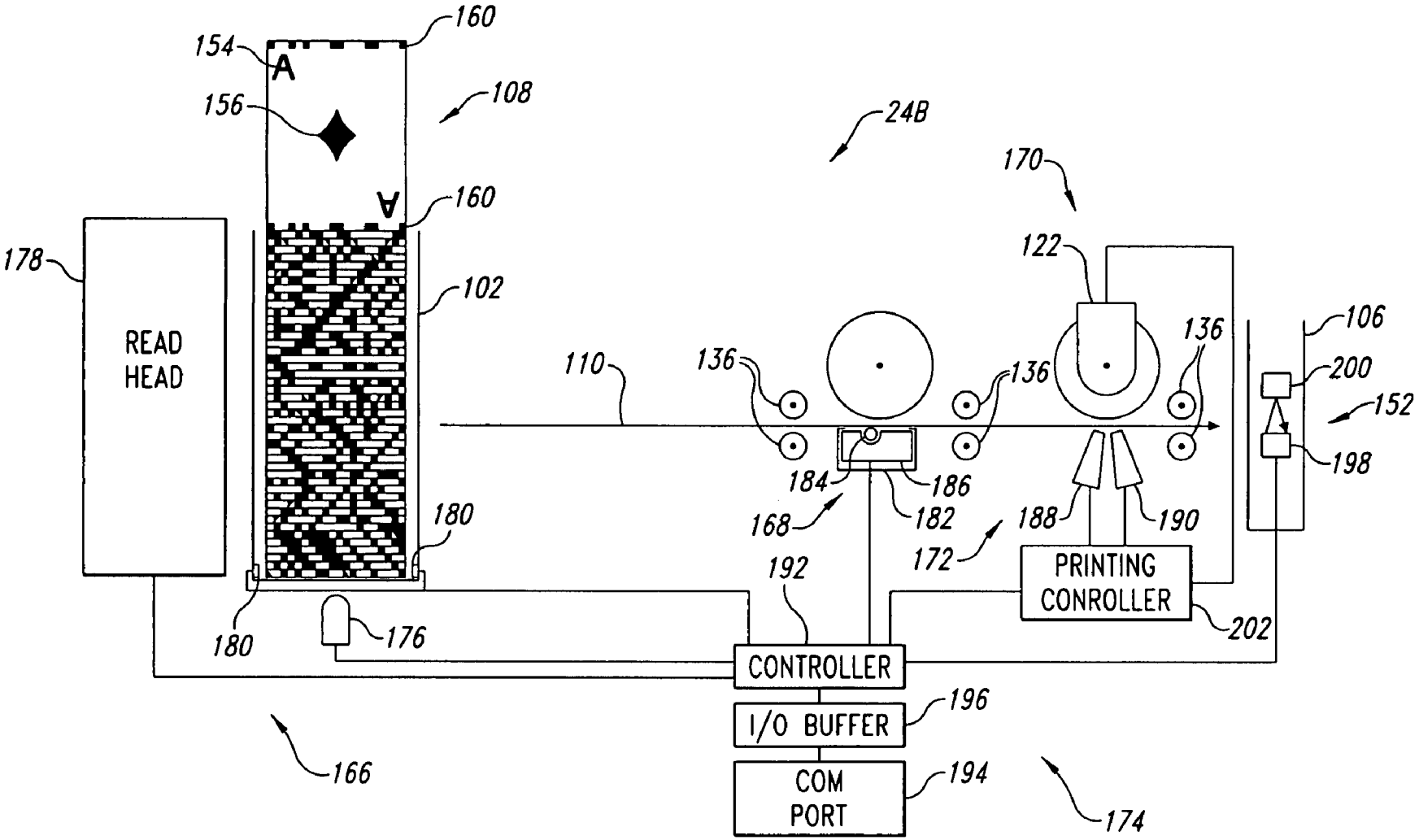
FIG. 6 is a schematic diagram of another embodiment of a card printing device, particularly suit for use with the automatic wager monitoring system of FIG. 1.

FIG. 6 shows another embodiment of the card distribution device 24, in the form of a second card printing device 24B. The second card printing device 24B generally includes a read mechanism 166, an erase mechanism 168, a drive mechanism 170, a print mechanism 172, and a control mechanism 174.

A set of playing cards 108 located in the card receiver 102 includes identifying markings previously printed on playing card blanks. The identifying markings include a markings 154 corresponding to a rank, markings 156 corresponding to a suit, and markings 160 in the form of machine-readable bar code symbols 160 encoding a unique serial number identifying the particular card and/or deck of playing cards. While visible in the illustration, the bar code symbols 160 may be printed with an ink that is only visible under a specific frequency of light, such as the UV range of the electromagnetic spectrum to prevent identification by the player 26.

The read mechanism 166 includes a light source 176 and a reader head 178 for imaging the identifying markings 154, 156, 160 on the playing cards. The read mechanism 166 may also include optical components such as mirrors, reflectors, lenses, filters and the like.

The light source 176 may be selectively operated in response to a read command received from the host computing system 12, and/or in response to the presence of playing cards 108 in the card receiver 102. The read mechanism 166 may include a card presence detector 180 that determines when there is one or more playing cards 108 in the card receiver 102. The card presence detector 180 may take the form of a light source directing light to a reflector across the card receiver 102, and a light detector to receive the reflected light. The presence of playing cards 108 in the card receiver 102 interrupts the light, which can trigger the light source 176 directly, and/or send an appropriate signal to the host computing system 12 which may transmit a return signal to trigger the light source 176. Likewise, the reader head 178 may also be triggered directly by the card presence detector 180, or indirectly via the host computing system 12. Alternatively, in certain embodiments, the reader head 178 may remain in an ON or active state, relying on the activation of the light source 176 to capture images of the playing cards 108 in the card receiver 102.

In one embodiment, the reader head 178 includes an area imager capable of imaging a two-dimensional area encompassing the machine-readable symbols 160 on each of the playing cards in a single image. For example the reader head 178 may include a two-dimensional array of charge coupled devices ("CCDs").

In another embodiment the reader head 178 can take the form of a linear imager having a field-of-view that can be swept across the machine-readable symbols 160 on each of the playing cards 108 in succession. The read mechanism 166 may employ any of a variety of methods and structures for sweeping the field-of-view of the reader head 178. For example, the reader head 178 can be pivotally mounted for movement with respect to the playing cards 108. Alternatively, a mirror or other optical component (not shown) can be pivotally mounted for movement with respect to the reader head 178 and the playing cards 108. Alternatively, the light source 176 can be pivotally mounted for movement with respect to the playing cards 108. Alternatively, a mirror or other optical component (not shown) can be pivotally mounted for movement with respect to the light source 176 and the playing cards 108.

In yet another embodiment, the reader head 178 and field-of-view of the reader head 178 may remained fixed while the playing cards 108 are transported past the field-of-view of the reader head 178.

In a further embodiment, the reader head 178 can take the form of a scanner, such as a laser scanner, for acquiring the machine-readable symbols 160. In such an embodiment the reader head 178 would include a laser light source, photodetector, amplifier and wave shaper. Laser scanners typically do not employ additional light sources, such as the light source 176.

The construction and operation of imagers and scanners for reading machine-readable symbols is generally known in the field of automatic data collection ("ADC"), so will not be described in further detail in the interest of brevity. The structure and operation of machine-readable symbol readers is generally discussed in *The Bar Code Book*, Palmer, Roger, C., Helmers Publishing, Inc., Peterborough, N.H. (Third Edition).

An erase mechanism 168 includes an erase head 182 positionable to erase selected markings on a playing card 108. In a simple embodiment, the erase head 182 includes a rotatably mounted eraser 184 and a motor 186 coupled to rotate the eraser 184 while the eraser is in contact with the playing card 108. The eraser 184 may have a cylindrical shape, with a longitudinal axis perpendicular to the card path 110.

The drive mechanism 170 includes a motor 122 coupled to directly drive a platen roller for advancing playing cards 108 along the playing card path 110. The drive mechanism 170 may also include guide rollers 136 for orienting and guiding the playing cards 108 along the playing card path 110.

The print mechanism 172 includes a first print head 188 and a second print head 190. The first print head 188 can print visible markings on the playing card, while the second print head 190 prints invisible markings (e.g., marking only visible under UV light) on the playing card. Two print heads 188, 190 may be particularly suitable where the print heads 188, 190 are ink jet print heads, requiring separate reservoirs of ink for printing visible and invisible markings. The print mechanism 172 may include additional or fewer print heads depending on the particular printing requirements. For example, the print mechanism 172 may employ separate print heads for red and black ink, or may employ additional print heads for other colors that make up the graphics on the playing cards. Alternatively, the print mechanism 172 may employ a single print head capable of handling multiple colors (e.g., color thermal printing, dye sublimation printing). The print heads 188, 190 receive print control signals from the control mechanism 174, such as signals identifying which print elements (not shown) of the print heads 188, 190 to activate at a particular time or position.

The control mechanism 174 includes a controller 192 that couples the various other components to a communications port 194 via an Input/Output ("I/O") buffer 196. The communications port 194 can take the form of any of a variety of communications ports such as D9 connector employing an RS232 protocol. The communications port 194 can allow communications with the host computing system 12 via the LAN 78 and/or WAN 80. The I/O buffer 196 serves as a holding area for data coming into and going out of the communications port 194. The controller 192 routes data, and can perform simple control functions. While the card printing device 24B may employ a microprocessor such as the microprocessor 142 (FIG. 4), a controller 192 provides a less expensive alternative, particularly where the network environment permits much of the processing to be distributed to other devices, for example to the host computing system 12.

The control mechanism 174 may also include a card level detector 152 for detecting a level or number of playing cards in the playing card holder 106. The card level detector 152 can include a light source and receiver 198 and a reflector 200 spaced across the playing card holder 106 from the light source and receiver 198. Thus, when the level of playing cards drops below the path of the light, the light sources and receiver 198 detects light reflected by the reflector 200, and the card level detector 152 provides a signal to the host computing system 12 via the controller 192 indicating that additional playing cards should be printed. The printing device 24B can employ other card level detectors, such as mechanical detectors.

The control mechanism 174 includes a printing controller 202 coupled to control the motor 122 and the print heads 188, 190.

In operation in the embodiment of FIG. 6, the host computing system 12 determines the playing card values and generates the pseudo-random playing card sequence. The host computing system 12 also generates the print data and provides the print data to the printing controller 202 via the controller 192 to control and synchronize the operation of the motor 122 and print heads 188, 190. The print data consists of instructions for printing markings on respective ones of the playing cards 108, after the playing cards have been erased, that correspond to respective playing card values from the random playing card sequence generated by the host computing system 12. Alternatively, the host computing system 12 can provide motor control signals and print control signals directly to the motor 122 and print heads 188, 190 via the controller 192. In a further alternative, the controller 192 can be configured to also serve as a printing controller, receiving the print data and providing the motor control signals and print control signals the motor 122 and print heads 188, 190. In yet a further alternative, the host computing system 12 can provide print data to a motor controller and print controller, such as the motor controller 148 and print controller 150 shown in FIG. 4, for controlling the motor 122 and print heads 188, 190, respectively.

Since the card printing device 24B receives data such as a random playing card sequence from the host computing system 12 and/or print data, the card printing device 24B of FIG. 5 may be a relatively low cost device, employing a simple controller 192 and/or print controller 202 rather than a relatively more expensive microprocessor. Thus, the card printing device 24B is particularly suited for use with the networked automated wager monitoring system 10 of FIG. 1. Thus, the card printing device 24B provides an integrated networked device for printing playing cards in a pseudo-random sequence.

The card printing device 24B also reads the playing cards 108 in the card receiver 102, allowing the tracking of playing and wagering according to methods described in commonly assigned U.S. patent applications: Ser. No. 60/130,368, filed Apr. 21, 1999; Ser. No. 09/474,858, filed Dec. 30, 1999, entitled "METHOD AND APPARATUS FOR MONITORING CASINO GAMING"; Ser. No. 60/259,658, filed Jan. 4, 2001; Ser. No. 09/849,456, filed May 4, 2001; and Ser. No. 09/790,480, filed Feb. 21, 2001, entitled "METHOD, APPARATUS AND ARTICLE FOR EVALUTING CARD GAMES, SUCH AS BLACKJACK". Additionally, the card printing device 24B reuses playing cards 108, erasing previous markings after reading the playing cards 108 and before printing new markings on the playing cards 108.

Real-time, or almost real time playing card printing may realize a number of distinct advantages over mechanical shufflers. For example, the playing card printing devices 24A, 24B can employ an unlimited number of "virtual" card decks (i.e., playing card values) in creating the random playing card sequence, only printing the limited number of physical playing cards required for playing a game. For example, the playing card printing device 24A, 24B can receive or generate, respectively, the random playing card sequence from 500 decks of cards or more, yet print only one or two decks of playing cards, or as few hands of playing cards, as needed. The playing card printing device 24A, 24B may also produce a more truly random sequence than a mechanical shuffler, which is prone to incomplete shuffling due to the inherent consistencies of mechanical systems. The card printing devices 24A, 24B may also increase the speed of play since the card printing devices 24A, 24B eliminate the need for repeated mechanical manipulations of the playing cards.

Wagering System Operation

Figure 7A:
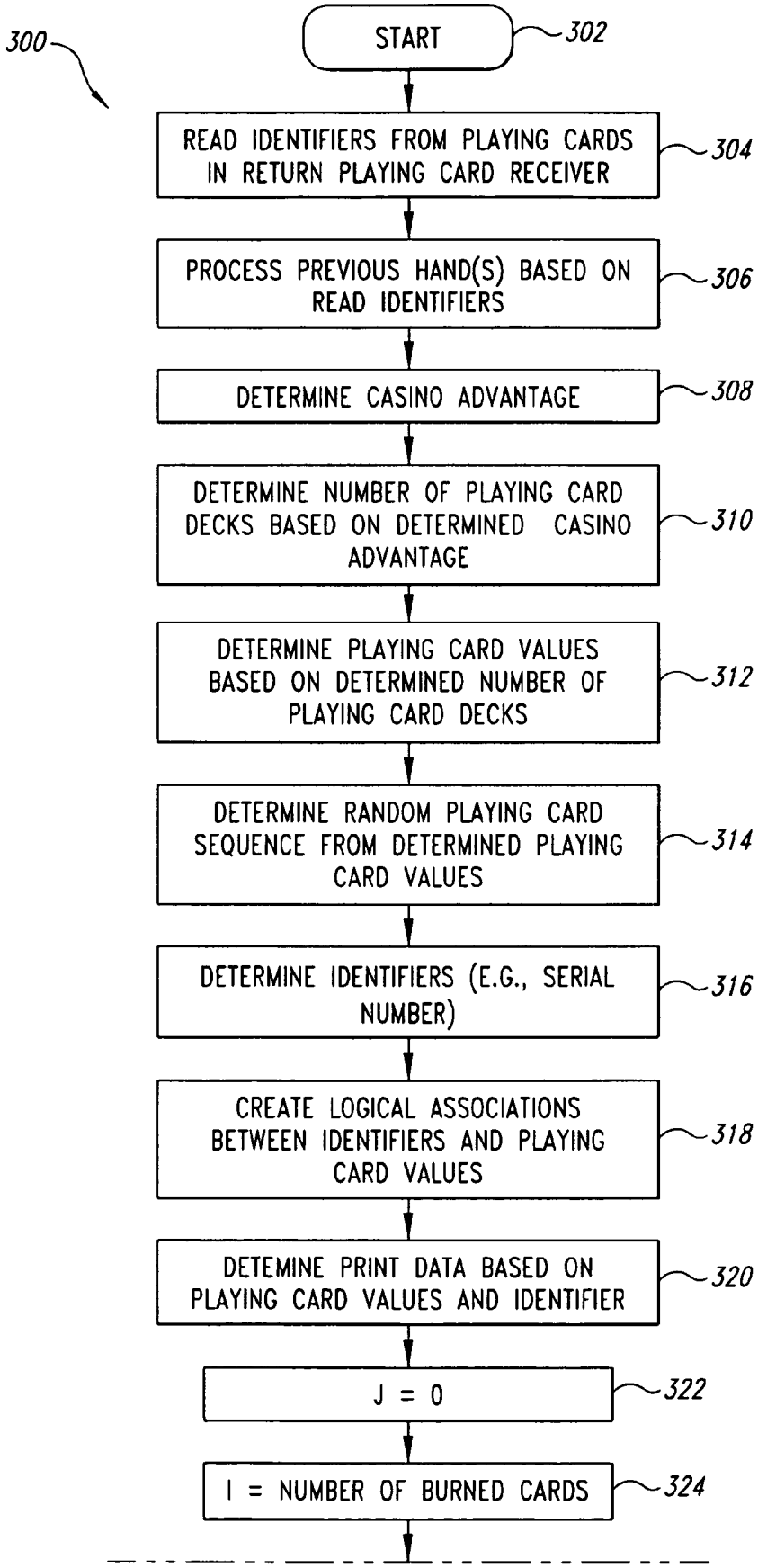
FIGS. 7A-7B are a flow diagram showing a method of operating the host computing system of FIG. 1 and the card distribution device of FIG. 6.
Figure 7B:
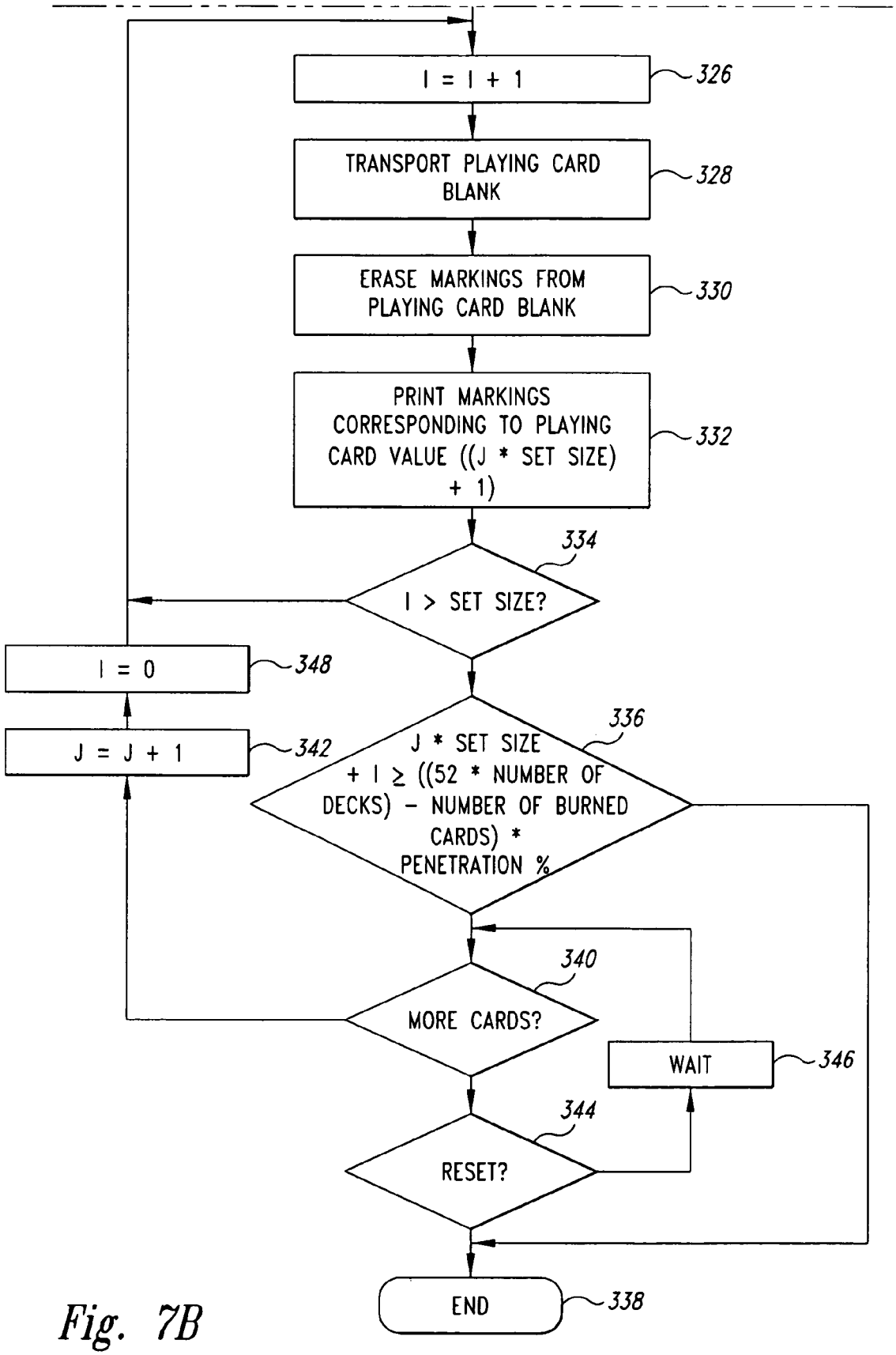

FIGS. 7A-7B show a method 300 of operation for the playing card printing device 24B of FIG. 6, starting in step 302. While discussed below in terms of remote operation by the host computing system 12, an appropriately configured card printing device 24B could execute some or all of those functions. Portions of the method 300 are also applicable to the playing card printing device 24A of FIG. 4.

In step 304, the card printing device 24B reads machine-readable symbols 160 from the playing cards 108 in the card receiver 102 employing the reader head 178, as generally described above. One skilled in the art will recognize the rank and suit markings 154, 156 could be read, however the machine-readable symbols are typically easier to process with existing hardware and software. In step 306, the host computing system 12 processes the previous hands based on the identifiers encoded in the read machine-readable symbols 160. The host computing system 12 can employ methods and apparatus taught in commonly assigned U.S. patent applications U.S. patent applications: Ser. No. 60/130,368, filed Apr. 21, 1999; Ser. No. 09/474,858, filed Dec. 30, 1999, entitled "METHOD AND APPARATUS FOR MONITORING CASINO GAMING"; Ser. No. 60/259,658, filed Jan. 4, 2001; Ser. No. 09/849,456, filed May 4, 2001; and Ser. No. 09/790,480, filed Feb. 21, 2001, entitled "METHOD, APPARATUS AND ARTICLE FOR EVALUTING CARD GAMES, SUCH AS BLACKJACK".

In step 308, the host computing system 12 determines the casino advantage for the game. Typically, the casino advantage is dependent on a number of factors, including the type of card game, the particular rules employed by the casino for the type of card game, and the number of decks or cards from which the cards are dealt. In an alternative embodiment, the casino advantage may also depend on the composition of those playing card decks where, for example, certain playing cards are removed or added to the card decks (e.g., 5 Aces in one or more card decks; and/or only 3 Kings in one or more card decks). The host computing system 12 may rely on a previously defined game type, game rules and number of decks, or may allow the dealer 30, or even the player 26, to select one or more of the parameters. For example, the dealer 30 may select the desired advantage and provide suitable house odds to the player 26 based on the advantage. Alternatively, the player 26 may select a set of desired house odds, and rely on the host computing system 12 to select the appropriate casino advantage corresponding to those house odds. Thus, the casino can offer the player 26 higher odds where the player 26 is willing to play against a hand dealt from a larger number of playing cards 108. The casino can also offer the player 26 higher odds where certain playing cards are omitted from one or more card decks. Additionally, or alternatively, the casino can offer the player higher odds or a bonus for receiving a particular hand, such as 5 sevens.

In step 310, the host computing system 12 determines the number of decks of playing cards required to deal a game having the determined casino advantage. In step 312, the host computing system 12 determines a set of playing card values based on the determined number of card decks. Typically, the host computing system 12 will employ one playing card value for every playing card rank and suit combination for each of the determined number of playing card decks (e.g., 52 playing card values per card deck). Thus, the host computing system 12 is working with "virtual" playing cards, or values representing playing cards in one or more "virtual" decks.

The playing card values can take any of a variety of forms which is capable of identifying each individual playing card, and which is convenient for computational use. For example, each playing card in a conventional deck can be assigned an integer value 1-52. Successive integers can be assigned where more than one card deck is used. For example, each playing card rank and suit combination in a second conventional deck can be assigned a respective integer playing card value from 53 to 104. The playing card rank and suit combinations in each "virtual" card deck may be in a matching predefined sequence. For example, the playing card value corresponding to the two of hearts combination may be 1 for the first deck and 53 for the second deck, while the playing card value for the Ace of spades may be 52 for the first deck and 104 for the second deck. Employing the same sequence for mapping the playing card values to the rank and suit combinations in multiple "virtual" card decks facilitates later card identification or recognition, while not hindering the generation of pseudo-random sequences.

In step 314, the host computing system 12 generates a pseudo-random playing card sequence from the determined playing card values. Methods of random number generation are well known in the computer arts so will not be described in detail. The random number generation employs a range initially including all of the determined playing card values. Thus, the host computing system 12 can generate a random sequence that is unaffected by mechanical consistencies of any device, or mechanical limitations on the total number of playing cards.

In step 316, the host computing system 12 determines identifiers for the playing cards 108, such as unique serial numbers. The identifier can uniquely identify the particular playing card, and/or the card deck to which the playing card belongs. A non-sequential assignment of identifiers may enhance security. In an alternative embodiment, discussed below, the machine-readable symbols 160 encoding the identifiers remain printed on the card blanks, thus new identifiers do not need to be determined.

In step 318, the host computing system 12 creates logical associations between the identifiers and the playing card values. For example, the host computing system 12 can store the logical association between playing card values and respective identifiers as a database stored in a computer-readable memory. The logical association maps the playing card values, and hence the rank and suit markings 154, 156 to be printed on a playing card 108, with the identifier which is to be printed on the same playing card 108 in the form of a machine-readable symbol 160.

In step 320, the host computing system 12 determines the print data based on the playing card values and identifiers. As discussed above, the print data includes the specific instructions for printing the various markings 154, 156 and/or 160 on the corresponding playing cards 108. In an alternative embodiment, the printing controller 202 can determine the print data based on the playing card values, identifier or other information supplied by the host computing system 12. For example, a computer-readable memory (not shown) in the card printing device 24B can store print data for each of the 52 different playing card faces in a typical card deck. A portion or all of the playing card value supplied by the host computing system 12 can identify the appropriate print data to the printing controller 202 for printing the corresponding playing card 108.

Where the host computing system 12 performs steps 316, 318 and/or 320 immediately after the step of determining the random playing card sequence 314, the host computing system 12 may determine the identifiers, create the logical associations and determine the print data for all of the playing card values in the random card sequence. Alternatively, the steps 316, 318 and/or 320 can be performed for smaller sets of playing cards, or even on a card-by-card basis, for example immediately before each playing card is printed. Thus, identifiers will not be assigned for cards which may never be used in play with the consequent benefit of conserving unique identifiers. This approach may also reduce the load on the host computing system 12, with consequent benefits in reduced infrastructure and/or increased operating speed.

The host computing system 12 and/or printing controller 202 initializes various counters in preparation for printing the physical playing cards 108 according to the computationally generated pseudo-random playing card sequence of playing card values. For example, in step 322 the host computing system 12 and/or printing controller 202 sets a first counter J equal to 0 (i.e., J=0). In step 324, the host computing system 12 and/or printing controller 202 sets a second counter I equal to a number of cards to be burned (e.g., I=3). Casinos typically skip an initial number of playing cards when dealing from a freshly shuffled card deck in a procedure commonly reference to as "burning the cards." This hinders a player's ability to accurately count cards. Setting the first counter J equal to the number of cards to be burned, prevents the card printing device 24B from printing these playing cards, possibly saving playing card blanks, ink and/or time. Alternatively, the number of playing cards to be burned can be set equal to 0, and the dealer 30 may physically discard an appropriate number of playing cards 108 prior to dealing. Casinos may find this method preferable as a visible deterrent to card counting, and/or to make the card game appear as similar as possible to conventionally dealt cards games.

In step 326, the host computing system 12 and/or printing controller 202 increments the second counter I (i.e., I=I+1) in preparation for printing the next playing card. In step 328, the drive mechanism 170 of the card printing device 24B transports a playing card 108 along the card path 110, employing the motor 122 as discussed generally above. In step 330, the erase mechanism 168 of the card printing device 24B erases the markings 154, 156, from the face of the playing card employing the erasure head 182 as generally described above. In some embodiments, the machine-readable symbol 160 may be erased in preparation to providing a new machine-readable symbol 160 encoding a new identifier such as a unique serial number. This procedure may provide enhanced security, making it more difficult to obtain the identifiers. In other embodiments, the machine-readable symbol 160 can be left in tact, and a new logical association made between the identifier or serial number encoded in the machine-readable symbol 160 and the new playing card value and/or the rank and suit markings 154, 156 assigned to the particular playing card 108.

In step 332, the print mechanism 172 of the card printing device 24B prints new markings 154, 156, and/or 160 on the playing card 108 employing the printing heads 188, 190.

In step 334, the host computing system 12 and/or printing controller 202 determines whether the second counter I is greater than a set size value. The set size value can be set to any convenient size. For example, the set size can be set to 52 playing cards where playing cards will be dealt from a hand-held deck by the dealer 30. If the second counter is not greater than the set size, control returns to step 350, where the second counter I is incremented in preparation for the next playing card. If the second counter is greater than the set size, control passes to step 348.

In step 336, the host computing system 12 and/or printing controller 202 determines whether there are sufficient playing card values remaining in the playing card sequence to print the next set of playing cards. Thus, the host computing system 12 and/or printing controller 202 assesses deck penetration (i.e., how many cards remain to be dealt). One way of assessing deck penetration is to determine whether the current card count is equal to or greater than the total number of cards multiplied by a deck penetration percentage. A suitable mathematical formula for such is given as: J*Set Size+I≧((52*Number of Decks)−Number of Burned Cards)*Percentage. Alternatively, the penetration can be represented as a number of cards that are not to be dealt. Thus, the mathematical representation would be given as: J*Set Size+I≧((52*Number of Decks)−Number of Burned Cards)−Number of Cards To Not Be Dealt.

If the host computing system 12 and/or printing controller 202 determine that the deck has been sufficiently penetrated, control passes to step 338 where the method terminates, although the method 300 may execute in a continuous loop, or in a multi-threaded fashion as suits the particular environment. The method 300 can then be restarted to produce a new set of playing cards in a pseudo-random sequence. If the host computing system 12 and/or printing controller 202 determine that the card deck 108 has not been sufficiently penetrated, control passes to step 340. In step 340, the host computing system 12 and/or printing controller 202 determine whether additional playing cards 108 should be printed. For example, the host computing system 12 and/or printing controller 202 can check the status of the card level detector 152 to determine whether a sufficient number of playing cards remain in the card holder 106.

If there are not sufficient playing cards control passes to step 342. If there are sufficient playing cards remaining, the controller 192 and/or host computing system 12 determines whether a reset has been requested, in step 344. A reset may be automatically requested, for example in response to an occurrence of an error condition, or may be manually requested. A manual request may occur, for example, by the dealer 30 selecting a reset or new shuffle switch when the dealer wishes to deal from a new set of cards. The dealer 30 or other casino personnel may select this option when, for example, the dealer 30 suspects the player 26 of card counting. If a reset condition has occurred, control is passed to step 338, where the method ends. If a reset condition has not occurred, the host computing system 12 and/or printing controller 202 execute a wait loop 346, returning control back to step 340.

In step 342, the host computing system 12 and/or printing controller 202 increments the first counter J, and in step 348 initializes the second counter I (i.e., I=0), in preparation for printing the next set of playing cards. The host computing system 12 and/or printing controller 202 passes control back to step 326 to print the next playing card 108.

While the embodiment of FIGS. 7A-7B employs the host computing system 12 for the primary portion of the processing, the processing may be distributed to other computing systems and/or processors distributed throughout a casino, or associated with one or more of the gaming tables 18. Distributing the processing may reduce the workload on the host computing system, allowing a smaller processor to handle more wagering, and perhaps providing faster results. However, retaining processing at the host computing system 12 may provide better control over the software, and may make changes to the software simpler. The above described system may also employ a mix of the above approaches, for example, retaining processing at the host computing system 12 for some aspects such as random number generation, while distributing the processing to card printing device 24A, 24B for other aspects such as generating print data and/or printing.

Figure 8A:
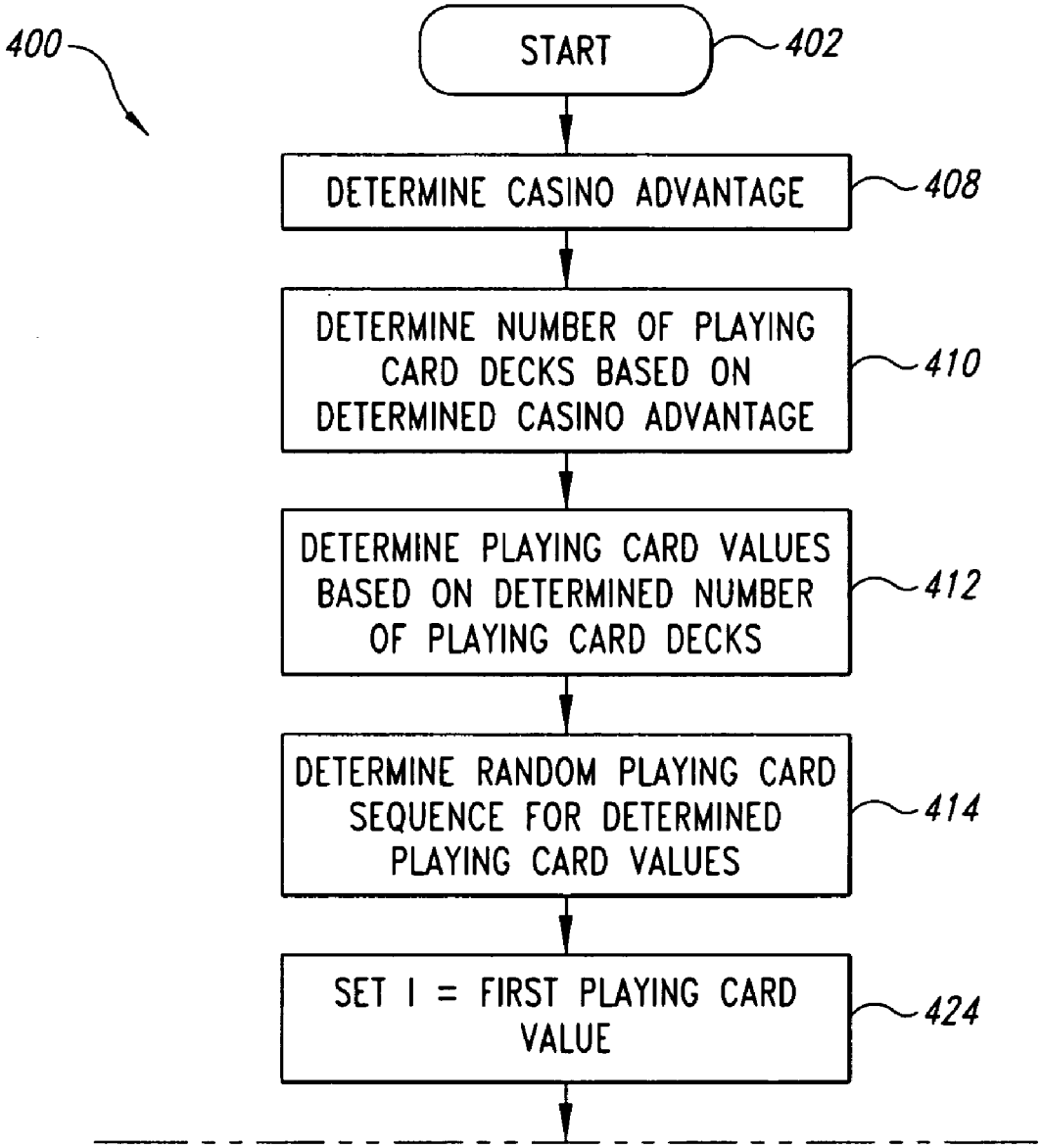
FIGS. 8A-8B are a flow diagram showing a method of operating the card distribution device of FIG. 4.
Figure 8B:
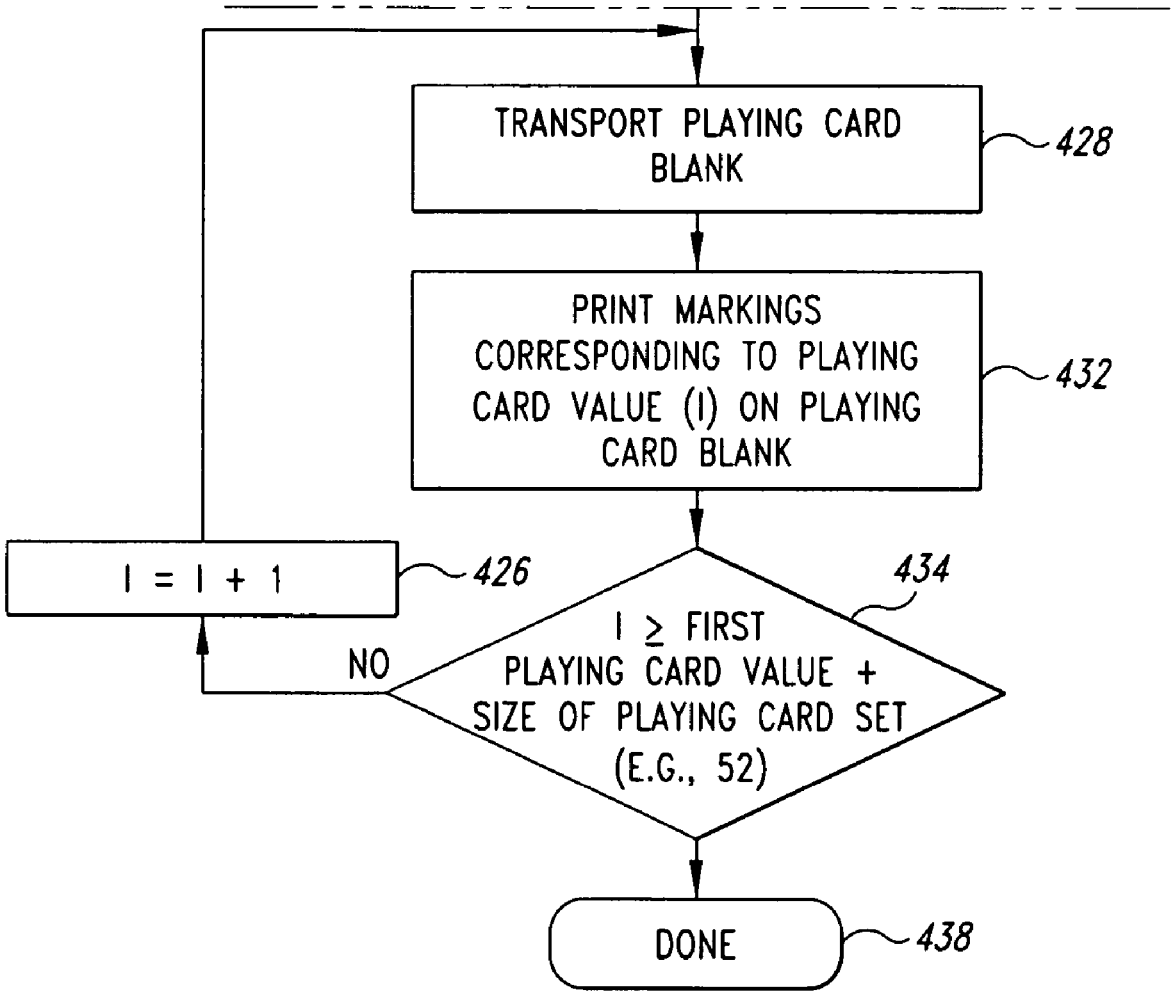

FIGS. 8A-8B show a method 400 of operation for the playing card printing device 24A of FIG. 4, starting in step 402. While discussed below in terms of remote operation by the microprocessor 142, an appropriately configured card printing device 24A could distribute some or all of those functions to an external computing system or processor such as a host computing system 12. Portions of the method 400 are similar to the method 300 of FIGS. 7A-7B, thus common acts and structures will be identified using similar reference numbers, differing only in the most significant digit (e.g., 312 is similar to 412), and only significant difference in operation will be discussed below.

The method 400 starts in step 402. In step 408, the microprocessor 142 determines the casino advantage for the game. Determining the casino advantage is been discussed in detail above.

In step 410, the microprocessor 142 determines the number of decks of playing cards required to deal a game having the determined casino advantage. In step 412, the microprocessor 142 determines a set of playing card values based on the determined number of card decks. In step 414, the microprocessor 142 generates a pseudo-random playing card sequence from the determined playing card values. In step 416, the microprocessor 142 determines identifiers for the playing cards 108, such as unique serial numbers. In optional step 418, the microprocessor 142 creates logical associations between the identifiers and the playing card values. In step 420, the microprocessor 142 determines the print data based on the playing card values and identifiers. The steps 416, 418 and/or 420 may be performed for smaller sets of playing cards, or even on a card-by-card basis, for example immediately before each playing card is printed. In step 424, the microprocessor 142 sets a first counter I equal to a first playing card value, including any of a number of cards to be burned (e.g., I=3). In step 428, the drive mechanism 112 (FIG. 4) of the card printing device 24A transports a playing card 108 along the card path 110. In step 432, the print mechanism 114 (FIG. 4) of the card printing device 24A prints new markings 154, 156, and/or 160 on the playing card 108 employing the printing head 138.

In step 434, the microprocessor 142 determines whether there are additional playing card values in the random sequence of playing cards. For example, the microprocessor 142 can determine whether the first counter I is equal to or greater than the total number of playing card values minus any burned cards and/or reserved cards (e.g., card penetration). If the there are additional playing cards, control passes to step 426, where the first counter I is incremented (I=I+1) in preparation for printing the next playing card. If there are no additional playing card values, the method 400 terminates in step 438, or alternatively returns to the start 402 to continuously execute.

Although specific embodiments of and examples for the card distribution device and method of operating the same are described herein for illustrative purposes, various equivalent modifications can be made without departing from the spirit and scope of the embodiments, as will be recognized by those skilled in the relevant art. The teachings provided herein of the embodiments can be applied to any networked systems, including the World Wide Web portion of the Internet. The teachings can also employ standalone systems, and/or to combinations of standalone and networked card distribution devices 24 in the same gaming environment. The teachings can apply to any type of card game where a random distribution of playing cards is desired, such as baccarat, 5-card stud poker, Caribbean stud poker, Tai Gow poker, Hi/Low, and Let-It-Ride™. While the illustrated embodiments show networked and standalone embodiments, the embodiments are not limited to such, and one skilled in the art can easily adapt the teachings herein to further levels of wagering. The card distribution device 24 can be used with a larger number of players. The card distribution device 24 can be used in environments other than casinos, such as taverns, betting parlors, and even homes. Additionally, the methods described above may include additional steps, omit some steps, and perform some steps in a different order than illustrated.

The teachings can also be adapted to employ playing cards formed of "smart paper," a product developed by Xerox Palo Alto Research Center, of Palo Alto, Calif. The smart paper consists of a flexible polymer containing millions of small balls and electronic circuitry. Each ball has a portion of a first color and a portion of a second color, each portion having an opposite charge from the other portion. Applying a charge causes the balls to rotate within the polymer structure, to display either the first or the second color. Charges can be selectively applied to form different ones or groups of the balls to from the respective markings 154-160 on the playing cards 108. The markings 154-160 remain visible until another charge is applied.

Alternatively, the teachings can be adapted to employ color-changing inks such as thermochromatic inks (e.g., liquid crystal, leucodyes) which change color in response to temperature fluctuations, and photochromatic inks that respond to variations in UV light.

The various embodiments described above can be combined to provide further embodiments. All of the above U.S. patents, patent applications and publications referred to in this specification as well as commonly assigned U.S. Provisional Application Ser. No. 60/296,866, filed Jun. 8, 2001, and U.S. Ser. No. 10/017,276, filed Dec. 13, 2001, are incorporated herein by reference in their entirety. Aspects of the embodiments can be modified, if necessary, to employ systems, circuits and concepts of the various patents, applications and publications to provide yet further embodiments.

While the illustrated embodiment typically discusses decks of playing cards, some embodiments may employ a lesser or greater number of playing cards, or can employ playing cards and/or decks other than the conventional playing card decks (i.e., 52 cards with ranks 2-10, Jack, Queen, King, and Ace and with four suits, heats, diamonds, spades and clubs).

These and other changes can be made to the embodiments in light of the above detailed description. In general, in the following claims, the terms used should not be construed to limit the claims to the specific embodiments disclosed in the specification and the claims, but should be construed to include all card distribution devices and method that operate in accordance with the claims. Accordingly, the claims are not limited by the disclosure.

We claim:

1. A gaming system, comprising:

an input device operable to receive selections indicative of at least one of a set of house odds or a house advantage for at least one hand to be played by at least one player of a card game, wherein the at least one of the set of house odds or the house advantage is selectable based on the selections input by the at least one player; and a playing card printing system including at least one head operable to form playing card markings on playing card media, the playing card printing system communicatively coupled to receive a number of signals based on the selections received at the input device and the playing card printing system responsive to the selections received at the input device to provide the at least one hand of physical playing cards, where the physical playing cards forming the at least one hand of physical playing cards correspond to at least one sequence of virtual playing card values that are pseudo-randomly generated based at least in part on the at least one of the set of house odds or the house advantage which the selections received at the input device are indicative of.

2. The gaming system of claim 1 wherein the selections received by the input device identify house advantages for respective hands of playing cards, and wherein the at least one set of virtual playing card values is pseudo-randomly generated based at least in part on the respective house advantage.

3. The gaming system of claim 1 wherein the selections indicative of the at least one of a set of house odds or a house advantage received by the input device include respective sets of house odds, and wherein the at least one set of virtual playing card values is pseudo-randomly generated based at least in part on a respective house advantage indicated by a respective one of the sets of house odds.

4. The gaming system of claim 1, further comprising: at least one processor configured to generate at least one sequence of the virtual playing card values based at least in part on selections received at the input device.

5. The gaming system of claim 1 wherein the playing card printing system includes at least one processor configured to generate at least one sequence of virtual playing card values based at least in part on selections received at the input device.

6. The gaming system of claim 1 wherein the playing card printing system includes at least one processor configured to generate at least one sequence of virtual playing card values based at least in part on selections received at the input device and to cause the head to form the playing card markings on the playing card media in an order based at least in part on the at least one sequence of virtual playing card values.

7. A method of operating a gaming system, the method comprising:

receiving selections at an input device, the selections indicative of at least one of a set of house odds or a house advantage for at least one hand of physical playing cards to be played by at least one player of a card game, wherein the at least one of the set of house odds or the house advantage is selectable based on the selections input by the at least one player;

pseudo-randomly generating a set of virtual playing card values based at least in part on the set of house odds or the house advantage indicated by the selections received at the input device; and forming playing card markings on playing card media to provide the at least one hand of physical playing cards, where the physical playing cards forming the at least one hand correspond to the set of virtual playing card values that are pseudo-randomly generated based at least in part on the selections received from the input device which selections are indicative of the at least one of the set of house odds or the house advantage.

8. The method of claim 7, wherein said receiving selections at the input device indicative of the at least one of a set of house odds or the house advantage for at least one hand of playing cards to be played by at least one player of a card game includes receiving a set of house odds selected by the at least one player.

9. The method of claim 7, further comprising:

determining a total number of playing card values from which the set of virtual playing card values will be generated based on the received selection; and wherein pseudo-randomly generating the set of virtual playing card values includes pseudo-randomly generating the set of virtual playing card values from the total number of virtual playing card values.

10. The method of claim 9 wherein said pseudo-randomly generating the set of virtual playing card values from the total number of virtual playing card values includes pseudo-randomly generating the set of virtual playing card values from an integer multiple of fifty-two virtual playing card values corresponding to respective ones of playing cards in a standard deck of playing cards.

11. The method of claim 7 wherein said forming the playing card markings includes printing the playing card markings on the playing card media in an order based at least in part on the set of virtual playing card values that are pseudo-randomly generated.

12. A computer-readable medium that stores computer-executable instructions that cause a computer to operate a gaming system, by:

receiving selections indicative of at least one of a set of house odds or a house advantage for at least one hand of physical playing cards to be played by at least one player of a card game, wherein the at least one of the set of house odds or the house advantage is selectable based on the selections input by the at least one player; and forming playing card markings on playing card media to provide the at least one hand of physical playing cards, where the physical playing cards forming the at least one hand of physical playing cards correspond to a sequence of virtual playing card values pseudo-randomly generated based at least in part on a respective one of the received selections indicative of the at least one of the set of house odds or the house advantage selected for the respective hand of physical playing cards.

13. The computer-readable medium of claim 12 wherein said receiving selections indicative of the at least one of a set of house odds or the house advantage for at least one hand to be played by at least one player of the card game includes receiving a signal indicative of a set of house odds selected by the at least one player.

14. The computer-readable medium of claim 12 wherein the computer executable instructions cause the computer to operate the gaming system further by:

for each of the hands of playing cards, determining a total number of virtual playing card values from which the set of virtual playing card values will be generated based on the respective one of the received selections; and pseudo-randomly generating the set of virtual playing card values from the total number of virtual playing card values.

15. The computer-readable medium of claim 14, wherein said pseudo-randomly generating the set of virtual playing card values from the total number of virtual playing card values includes pseudo-randomly generating the set of virtual playing card values from an integer multiple of fifty-two virtual playing card values corresponding to respective ones of playing cards in a standard deck of playing cards.

16. The computer-readable medium of claim 12 wherein said forming playing card markings on playing card media to provide the at least one hand of playing cards includes printing the playing card markings on the playing card media in an order based at least in part on the set of virtual playing card values that are pseudo-randomly generated.

* * * * *